US006771926B2

(12) United States Patent
Ishikawa et al.

(10) Patent No.: US 6,771,926 B2
(45) Date of Patent: Aug. 3, 2004

(54) FIXING BELT AND FUSER

(75) Inventors: Kiyotaka Ishikawa, Kanagawa (JP); Yoshio Kanesawa, Kanagawa (JP); Motoi Noya, Kanagawa (JP); Sadao Okano, Kanagawa (JP); Shinichi Utsumi, Kanagawa (JP); Hideaki Seikiguchi, Kanagwa (JP); Kazuhisa Masuko, Kanagawa (JP); Michiaki Yasuno, Kanagawa (JP); Fumio Daishi, Kanagawa (JP); Makoto Omata, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/404,100

(22) Filed: Apr. 2, 2003

(65) Prior Publication Data

US 2003/0206757 A1 Nov. 6, 2003

Related U.S. Application Data

(62) Division of application No. 09/879,011, filed on Jun. 13, 2001, now Pat. No. 6,618,573.

(30) Foreign Application Priority Data

Sep. 20, 2000 (JP) ..... P2000-286191
Sep. 20, 2000 (JP) ..... P2000-286203

(51) Int. Cl.[7] ..... G03G 15/20

(52) U.S. Cl. ..... 399/329; 219/216; 399/328; 399/324; 399/341

(58) Field of Search ..... 219/216; 399/122, 399/92, 94, 328, 329, 324, 341

(56) References Cited

U.S. PATENT DOCUMENTS

| | | | | |
|---|---|---|---|---|
| 5,893,666 | A | | 4/1999 | Aslam et al. |
| 6,010,791 | A | * | 1/2000 | Tan et al. ..... 399/329 |
| 6,243,559 | B1 | | 6/2001 | Kurotaka et al. |
| 6,377,777 | B1 | | 4/2002 | Kishino et al. |

FOREIGN PATENT DOCUMENTS

| | | |
|---|---|---|
| JP | 4-216580 | 8/1992 |
| JP | 5-72926 | 3/1993 |
| JP | 10-111613 | 4/1998 |
| JP | 11-143279 | 5/1999 |

* cited by examiner

*Primary Examiner*—Hoang Ngo
(74) *Attorney, Agent, or Firm*—Morgan, Lewis & Bockius LLP

(57) ABSTRACT

In a fuser, a cooling structure (5) is disposed so that a bend angle ($\alpha$) of a part bent during the time between an endless belt (3) coming in contact with a press cooling face (5*a*) of the cooling structure (5) and exiting from the press cooling face (5*a*) is placed in the range of 0° C.<$\alpha \leqq$7° C. A fixing belt has a minute hardness of 0.1 to 5 at least on the belt surface coming in contact with toner T and preferably has a gloss degree of 75 or more on the belt surface.

2 Claims, 19 Drawing Sheets

FIXING BELT AND FUSER

This is a divisional of application Ser. No. 09/879,011 filed Jun. 13, 2001, now U.S. Pat. No. 6,618,573 the disclosure of which is hereby incorporated by reference herein in its entirety.

BACKGROUND OF THE INVENTION

1. Field of the Invention

This invention relates to a fixing belt and a fuser using the fixing belt for fixing a toner image formed in an image formation apparatus such as a printer or a copier using electrophotography on a record sheet and in particular to a fuser for heating and pressurizing the record sheet to fix a toner image and then cooling the record sheet by cooling means with the record sheet abutted against an endless belt before peeling off the record sheet.

2. Description of the Related Art

In recent years, a fuser comprising an endless belt placed on at least a heating roll and a peeling roll spaced from the heating roll and rotating, a pressurizing roll for pressing the endless belt against the heating roll, and a cooling structure for coming in contact with the inner peripheral surface of the endless belt from the heating roll to the peeling roll and cooling wherein the endless belt is rotated in a passage direction in the order of the heating roll, the cooling structure, and the peeling roll, a record sheet supporting a toner image is introduced into a press area (nip part) between the endless belt placed on the heating roil and the pressurizing roll, the portion of the record sheet with which the cooling structure comes in contact in a state in which the record sheet is abutted against the endless belt is passed through, and the record sheet is transported to the portion of the endless belt placed on the peeling roll and is peeled off, whereby the toner image is fixed onto the record sheet has been proposed as a fuser used with an image formation apparatus using electrophotography (for example, JP-A-4-216580, JP-A-5-72926, etc.,).

The fuser described in JP-A-4-216580 adopts as the cooling structure, a cooling roll of air cooling type disposed so that the cooling roll can come in and out of contact with the inner peripheral surface of the endless belt (refer to FIG. 5, etc., in JP-A-4-216580) and the fuser described in JP-A-5-72926 adopts as the cooling structure, an air cooling box comprising a large number of air ventilation holes made in a contact face with the inner peripheral surface of the endless belt (refer to FIG. 2, etc., in JP-A-5-72926) In both fusers, the record sheet supporting the toner image is heated and pressurized and then is cooled by the cooling roll or the air cooling box with the record sheet abutted against the endless belt before the record sheet is peeled off the endless belt for fixing the toner image.

By the way, in such a fuser for heating and pressurizing the record sheet to fix the toner image and then cooling the record sheet with the record sheet abutted against the endless belt and peeling the record sheet, how the cooling is executed uniformly and stably is one problem.

That is, in the fuser adopting the cooling roll, the cooling roll is simply brought into contact with the endless belt and thus the endless belt comes in insufficient contact with the cooling roll and an uncooled portion occurs because of deformation like wrinkles or waves occurring on the endless belt and consequently the toner image on the record sheet after being heated and pressurized is not uniformly cooled and it is feared that unevenness may also occur in the image quality accordingly.

In the fuser adopting the air cooling box, the air cooling box is pressed against the endless belt and thus can be brought into almost sufficient contact with the endless belt for uniformly cooling the endless belt except that the contact is impaired as much as the presence of a large number of air ventilation holes. However, if the amount of pressing the air cooling box against the endless belt is too large and the belt is bent largely, the record sheet after being heated and pressurized easily peels off the endless belt portion against which the record sheet is pressed by the air cooling box, or also easily peels off the endless belt when it leaves the endless belt portion against which the record sheet is pressed and consequently the toner image on the record sheet after being heated and pressurized is not uniformly cooled and it is feared that an image quality failure may occur because of such cooling unevenness. Moreover, although such cooling unevenness is prevented to some extent if on the opposite side of the air cooling box with the endless belt between, an endless belt with an air cooling box coming in contact with the outer peripheral surface of the endless belt is also disposed, as disclosed in JP-A-5-72926, a condition in which the record sheet easily peels off the belt always exists depending on the pressing amount of the air cooling box cooling the inner peripheral surface of the belt and thus it is feared that cooling unevenness may be induced.

Incidentally, as fixing belts, there has been known an image fixing film described in, for example, JP-A-10-111613, a fixing belt described in JP-A-11-143279, and the like have been known as fixing belts.

The former fixing belt comprises a rubber elastic layer (JIS-A hardness 1–70°, layer thickness 0.1–3 mm) made of silicone rubber, etc., and a release property surface layer (layer thickness 5–50 $\mu$m) made of fluorine resin placed in order on a base material of a polyimide film. The latter fixing belt comprises a heat-resistant elastic layer (layer thickness 0.07 mm or more) made of fluorine rubber, silicone rubber, etc., on a base material of metal, etc., and comprises an outermost layer made of fluorine resin having a surface coarseness of Ra 1 $\mu$m or less (layer thickness 2–100 $\mu$m). Moreover, splanchnic release oil (fluorosilicone oil) is applied to the belt surface for use.

By the way, if such a fixing belt in the related art is applied to a fuser of the type wherein a record sheet P formed on the surface of a base material 1140 with a transparent resin layer 1150 made of a thermoplastic resin, etc., for supporting toner T and a fixing belt 1200 are heated and pressurized in a state in which they are overlaid on each other so that the toner T and belt surface 1200*a* face each other, whereby the toner T is fixed into the transparent resin layer 1150 of the record sheet P as shown in FIG. 29A, the following problem is involved:

In the fuser, as illustrated in FIG. 29B, the toner T needs to be sufficiently buried into the thermoplastic transparent resin layer 1150 and thus the record sheet P supporting the toner T and the fixing belt 1200 are heated and pressurized in a state in which they are overlaid on each other as described above, whereby the toner T and the transparent resin layer 1150 are fused and the toner T is buried into the fused transparent resin layer 1150 through the fixing belt 1200.

If the fixing is executed, an air bubble pool (so-called edge void) 1300 occurs in an edge part of an image made of the toner T (particularly a cross part of line drawings crossing each other) as illustrated in FIG. 30A; this is a problem. Such an image edge part void easily occurs if a hard fixing belt 1200 (formed with a hard resin coat layer).

The possible reason is as follows: As shown in FIG. 31A, the hard fixing belt 1200 cannot sufficiently follow level difference h between an image portion of the toner T and a non-image portion (exposure face of the transparent resin layer 1150) on the record sheet P and cannot become deformed and thus a gap k is formed between the fixing belt 1200 and the transparent resin layer 1150 and pressurizing through the fixing belt 1200 at the fixing time (hollow arrows in the figure) becomes non-uniform in the presence of the gap k (namely, high pressurization state for the high-level image portion and low pressurization state for the low-level non-image portion). Consequently, the toner T is strongly and rapidly buried into the transparent resin layer 1150 by the fixing belt 1200 and thus air bubbles are involved in the boundary portion between the toner T and the resin layer, are not sufficiently lost, are cooled and hardened, and remain in the boundary portion.

If the fixing is executed, smoothing of the image surface after the fixing becomes insufficient and the image having a sense of asperities (relief-toned image) results; this is also a problem. Such an image surface smoothing failure easily occurs if a too soft fixing belt 1200 (coated with a soft resin layer). The possible reason is as follows: As shown in FIG. 31B, if there is a multiple toner image portion (pile height) with a plurality of color toners superposed like a color image, the soft fixing belt 1200 becomes deformed following the level difference between the multiple toner image portion and a non-image portion, but the pressure through the fixing belt 1200 at the fixing time is scattered (namely, the pressure concentrates on the lower-level non-image portion of a relatively wider area than the image portion) and consequently the toner T is not sufficiently buried into the transparent resin layer 1150 by the fixing belt 1200.

In addition, with a fixing belt formed with a soft coat layer made of silicone rubber, etc., if a wax component as a mold release agent is added to the toner T, the wax component is transferred (offset) to the surface of the fixing belt at the fixing time and a ghost corresponding to the offset wax component transfer state (pattern) may occur on the later fixed image. With a fuser for transporting a record sheet to fix a toner image from a heating and pressurizing section to a peeling section with the record sheet brought into intimate contact with a fixing belt, thereby fixing the toner image on the record sheet, if the toner containing the wax component is used, the adherence of the fixing belt and the record sheet to each other is degraded in the presence of the wax component and an intimate contact failure of the record sheet with the fixing belt occurs. Consequently, smoothing of the fixed image surface becomes insufficient or the record sheet being transported peels off the fixing belt and is easily detached.

The former fixing belt described above comprises the release property surface layer made of fluorine resin, so that toner onto the fixing belt or wax component offset becomes hard to occur, but the smoothness of t he release property surface layer is low and a fixed image rich in gloss, for example, is hard to provide. Further, with the latter fixing belt described above, unevenness occurs in smoothness because of the release oil applied to the belt surface and still a fixed image rich in gloss is hard to provide.

SUMMARY OF THE INVENTION

It is therefore an object of the invention to provide a fuser that can uniformly and stably cool an endless belt from a heating roll to a peeling roll and a record sheet to support a toner image to be fixed, transported with the record sheet abutted against the endless belt by cooling means for cooling while pressing the endless belt from the inner peripheral surface thereof and can accomplish good fixing with no cooling unevenness as a fuser of the type wherein a record sheet to support a toner image to be fixed is cooled by cooling means with the record sheet abutted against an endless belt and then is peeled.

It is another object of the invention to provide a fixing belt capable of executing good fixing excellent in smoothness without occurrence of voids in image edge parts or a smoothing failure of the image surface if fixing as described above is executed and a fuser capable of accomplishing such good fixing using the fixing belt.

To achieve the above objects, according to a first aspect of the invention, there is provided a fuser comprising:

a heating roll;

a peeling roll being spaced from said heating roll;

an endless belt being at least placed on said peeling roll and said heating roll and run;

a pressurizing roll for pressing said endless belt against said heating roll; and a cooling structure having a press cooling face being disposed on an inner peripheral surface of said endless belt for cooling the inner peripheral surface portion of said endless belt from said heating roll to said peeling roll while pressing the inner peripheral surface portion in a direction of an outer peripheral surface of said endless belt;

wherein said endless belt is run in a passage direction in the order of said heating roll, said cooling structure, and said peeling roll; and wherein a record sheet to support a toner image is introduced into a press area between said endless belt placed on the heating roll and said pressurizing roll, the portion of the record sheet with which the press cooling face of the cooling structure comes in contact in a state in which the record sheet is abutted against said endless belt is passed through, and the record sheet is transported to the portion of said endless belt placed on said peeling roll and is peeled off, whereby the toner image is fixed onto the record sheet.

In the fuser, said cooling structure is disposed so that a bend angle ($\alpha$) of a part bent during the time between said endless belt coming in contact with the press cooling face of said cooling structure and exiting from the press cooling face is placed in the range of $0° C. < \alpha \leqq 7° C$.

Also, according to a second aspect of the invention, there is provided a fixing belt shaped in an endless belt being over laid on a record sheet to support toner for fixing the toner onto the record sheet as said fixing belt and the record sheet are heated and pressurized, wherein minute hardness of a surface of said fixing belt coming in contact with the toner is 0.1 to 5.

Further, according to a third aspect of the invention, there is provided a fuser comprising:

a fixing belt shaped in an endless belt being overlaid on a record sheet to support toner for fixing the toner onto the record sheet as said fixing belt and the record sheet are heated and pressurized, wherein as the fixing belt, a fixing belt as claimed in claim 10 is used.

DETAILED DESCRIPTION OF THE PREFERRED EMBODIMENTS

Now, a description will be given in more detail of preferred embodiments of the invention with reference to the accompanying drawings.

Figure 1:
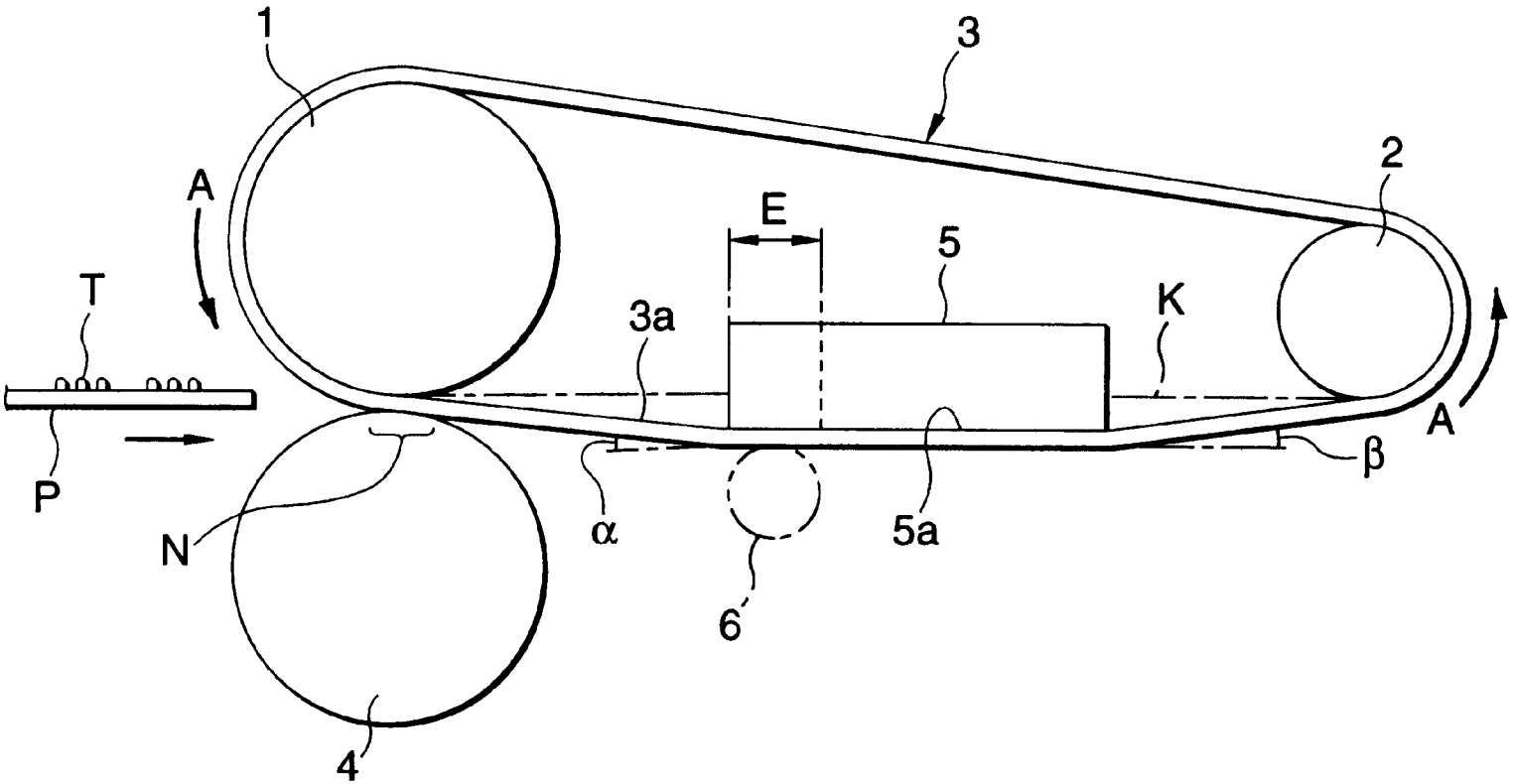
FIG. 1 a conceptual drawing to illustrate the main configuration of a fuser of the invention.

According to the invention, as illustrated in FIG. 1, there is provided a fuser comprising a heating roll 1, a peeling roll 2 being spaced from the heating roll 1, an endless belt 3 being at least placed on the peeling roll 2 and the heating roll 1 and run, a pressurizing roll 4 for pressing the endless belt 3 against the heating roll 1, and a cooling structure 5 having a press cooling face 5*a* being disposed on the inner peripheral surface 3*a* of the endless belt 3 for cooling the inner peripheral surface portion of the endless belt 3 from the heating roll 1 to the peeling roll 2 while pressing the inner peripheral surface portion in a direction of the outer peripheral surface 3*b* of the endless belt 3, wherein the endless belt 3 is run in a passage direction A in the order of the heating roll 1, the cooling structure 5, and the peeling roll 2, a record sheet P to support a toner image T is introduced into a press area N between the endless belt 3 placed on the heating roll 1 and the pressurizing roll 4, the portion of the record sheet P with which the press cooling face 5*a* of the cooling structure 5 comes in contact in a state in which the record sheet P is abutted against the endless belt 3 is passed through, and the record sheet P is transported to the portion of the endless belt 3 placed on the peeling roll 2 and is peeled off, whereby the toner image is fixed onto the record sheet, characterized in that the cooling structure 5 is disposed so that a bend angle α of a part bent during the time between the endless belt 3 coming in contact with the press cooling face 5*a* of the cooling structure 5 and exiting from the press cooling face 5*a* is placed in the range of $0° C. < \alpha \leqq 7° C$. An alternate long and short dash line K indicates a state in which the endless belt 3 is not pressed by the cooling structure 5 and is naturally placed on the heating roll 1 and the peeling roll 2; for convenience, it is assumed to be a line touching the tops of the roll faces of both the heating roll 1 and the peeling roll 2.

The cooling structure 5 may be of any configuration if it comprises the press cooling face 5*a* for cooling while pressing the fixing belt heated at the fixing time (in fact, cooling the record sheet P to support a toner image with the record sheet P abutted against the endless belt). For example, the cooling structures are roughly classified according to the whole form into those of roll form or belt form disposed so as to rotate and those fixedly disposed. The applicable cooling system is not only air cooling, but also a system using a cooling medium (system for circulating water, a coolant, etc.) or the like. As a preferable cooling structure 5, for example, a radiation member is pressed against and brought into contact with an endless belt and is air-cooled from the viewpoints of a wide contact area with the inner peripheral surface of the endless belt, good cooling efficiency, and a simple configuration. It is desired that the press cooling face 5*a* should be a smooth face from the viewpoint of providing intimate contact property with the endless belt.

The number of bend angles α may be one or more depending on the form of the cooling structure 5 or the form of the press cooling face 5*a*. In any case, at the part where the endless belt 3 comes-in contact with the press cooling face 5*a*, the bend angle α is the angle which the endless belt 3 forms with the state line where the endless belt 3 is naturally placed on the heating roll 1 and the peeling roll 2 (is not pressed by the press cooling face). The state line mentioned here is the same as the alternate long and short dash line K shown in FIG. 1.

Figure 2A:
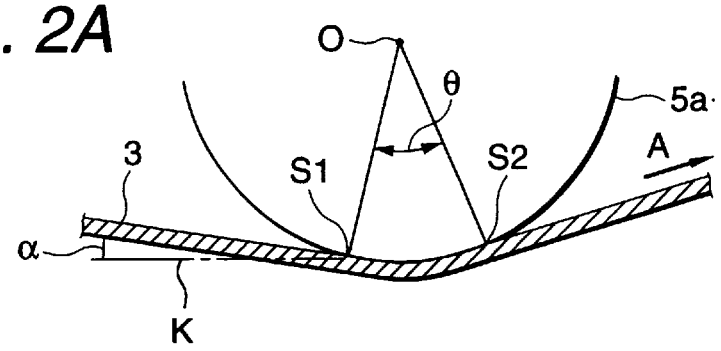
FIGS. 2A to 2C are schematic representations to show representative examples of bend angle α (β)
Figure 2B:
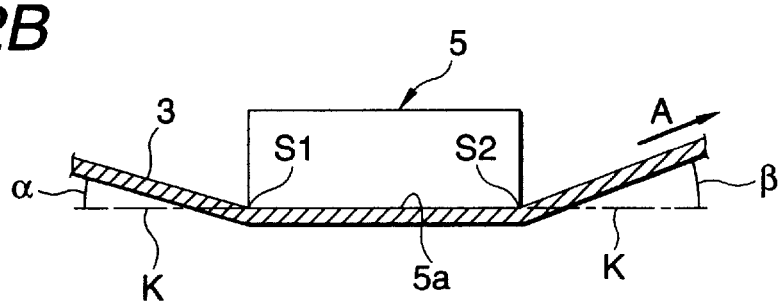
Figure 2C:
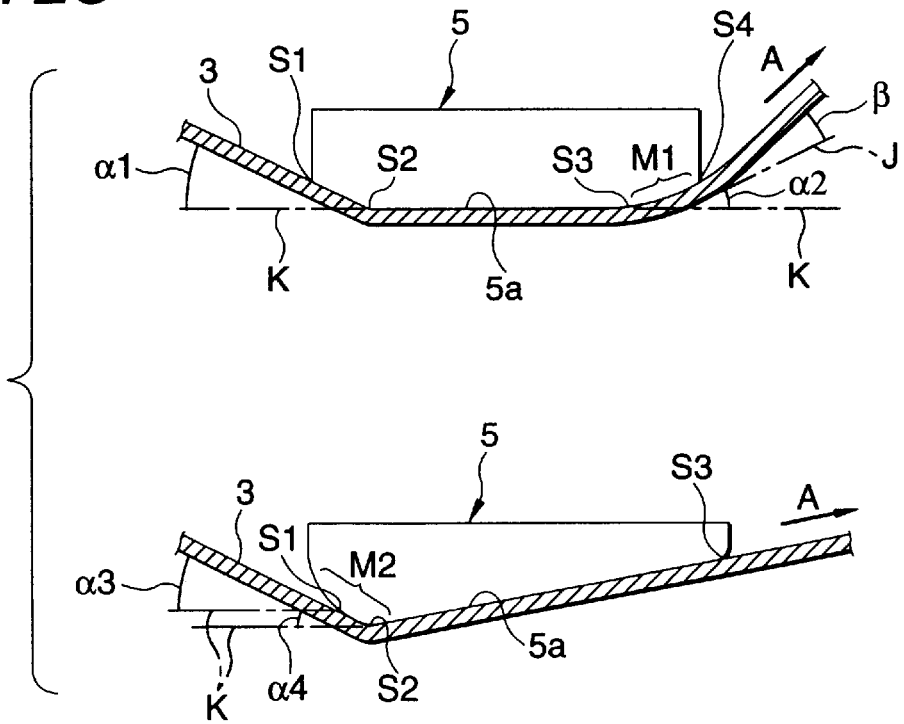

FIGS. 2A to 2C show representative examples of the bend angle α accompanying the differences in forms of the cooling structure and the press cooling face. FIG. 2A illustrates the bend angle α when the cooling structure 5 is of roll form as it rotates or the press cooling face 5*a* is a cylindrical curved surface. In the figure, symbol S1, S2 denotes the first or last contact point of the endless belt with the press cooling face, symbol O denotes the center point of the roll or the cylindrical curved surface, and symbol θ denotes the lap angle of the endless belt. Every alternate long and short dash line K in FIGS. 2A to 2C is the same as the alternate long and short dash line K shown in FIG. 1 and indicates a parallel move to the position crossing the portion where the endless belt 3 first comes in contact with the press cooling face. FIG. 2B illustrates the bend angle α when the cooling structure 5 is a fixedly disposed member and the press cooling face 5*a* is a flat surface. Further, FIG. 2C shows bend angles α1 to α4 of bent parts of the endless belt 3 when the cooling structure 5 is a fixedly disposed member and the press cooling face 5*a* is partially a curved surface and partially a flat surface. In the figure, symbols M1 and M2 denote each the curved surface portion of the press cooling face 5*a* (the portion of each press cooling face 5*a* not indicated by M1, etc., is a flat surface portion). In this connection, as for the cooling structure 5 (press cooling face 5*a*) shown in the upper part of FIG. 2C, the endless belt 3 is not bent at the contact point S1 and is first bent at the contact point S2.

If the bend angle α is equal to or less than 0°, the press cooling face of the cooling structure does not press the endless belt and a non-contact portion where the endless belt is not in contact with the press cooling face easily occurs and cooling unevenness easily occurs. In contrast, if the bend angle α exceeds 7°, the record sheet to support a toner image to be fixed easily peels off the endless belt (because of the effects of the tare weight and firmness of the record sheet) during the time between the endless belt coming in contact with the press cooling face of the cooling structure and exiting from the press cooling face, and uniform and sufficient cooling cannot be accomplished.

According to the fuser of the invention, particularly the cooling structure for cooling while pressing the endless belt is disposed so that the bend angle α of the part bent during the time between the endless belt coming in contact with the press cooling face of the cooling structure and exiting from the press cooling face is placed in the above-mentioned specific range, so that the record sheet to support a toner image to be fixed is transported in an intimate contact state without peeling off the endless belt portion pressed by the press cooling face of the cooling structure (forcible cooling area by the cooling structure) during the time between the record sheet entering and exiting from the endless belt portion. Accordingly, the record sheet to support a toner image to be fixed is cooled uniformly and stably in an intimate contact state with the endless belt after it is heated and pressurized.

The cooling structure 5 in the fuser may be disposed so that the bend angle β of the exit part of the endless belt 3 from the press cooling face 5*a* of the cooling structure 5 in a bend state is placed in the range of 0° C.<β≦22° C.

The bend angle β is an angle condition which becomes necessary if the endless belt 3 exits from the press cooling face 5*a* of the cooling structure 5 in a bend state, as illustrated in FIG. 2*b* and the upper part of FIG. 2C. Thus, the bend angle β is not involved in a configuration in which the endless belt 3 exits linearly from the press cooling face 5*a* without being bent, as illustrated in the lower part of FIG. 2C. In this connection, the bend angle β becomes equal to 0° as for the endless belt 3 in the configuration in which the endless belt 3 exits linearly. Therefore, the bend angle β becomes the angle indicating the bend state when the endless belt 3 passes through and exits from the press cooling face 5*a*. More particularly, for example, if the press cooling face 5*a* before the endless belt 3 exits therefrom is parallel with the state line K where the endless belt 3 is naturally placed on the rolls, the bend angle β becomes the angle which the endless belt 3 forms with the state line K, as illustrated in FIG. 2B, and if the press cooling face 5*a* just before the endless belt 3 exits therefrom is not parallel with the state line K where the endless belt 3 is naturally placed on the rolls (for example, it is inclined or is a curved surface), the bend angle β becomes the angle which the endless belt 3 forms with a tangent or extension J at the exit part of the press cooling face 5*a* just before the endless belt 3 exits therefrom, as illustrated in the upper part of FIG. 2C.

In such a configuration as for the bend angle β, the record sheet to support a toner image to be fixed does not peel off the endless belt exiting from the press cooling face of the cooling structure and is transported in an intimate contact state with the endless belt. Accordingly, the record sheet to support a toner image to be fixed is sufficiently cooled in the intimate contact state with the endless belt until it is peeled at a peeling point on the peeling roll.

The press cooling face 5*a* of the cooling structure 5 in the fuser may be a curved surface having a curvature relative to the belt rotation direction A. In this case, the curvature is appropriately selected mainly considering providing the adhesion of the endless belt to the press cooling face. In such a configuration, the endless belt comes in sufficient contact with the press cooling face of the cooling structure in a more intimate contact state. Accordingly, the record sheet to support a toner image to be fixed is more reliably cooled by the cooling structure through the endless belt coming in contact with the press cooling face as the curved surface.

Further, in each fuser as described above, a press rotation body for pressing the endless belt 3 against the press cooling face 5*a* of the cooling structure 5 from the outer peripheral surface of the endless belt 3 may be disposed. Such a press rotation body may of a roll form or a belt form of placing the endless belt on the support rolls for rotation. In such a configuration, as the endless belt is pressed by the press rotation body, it comes in contact with the press cooling face at a higher contact pressure and more reliably and uniformly. Accordingly, the cooling efficiency of the endless belt and the record sheet by the cooling structure is more enhanced and cooling unevenness is lessened.

The position of the press rotation body 6 pressing the endless belt 3 in the fuser may be at least within an area E to inner side 30 mm from the point of the press cooling face 5*a* of the cooling structure 5 with which the endless belt 3 first comes in contact. In such a configuration, a non-contact portion easily occurring just after the endless belt comes in contact with the press cooling face is reliably pressed by the press rotation body from the outer peripheral surface of the belt and is lost and the endless belt is brought into intimate contact with the press cooling face more reliably.

The part of the press rotation body 6 coming in contact with the endless roll 3 in the fuser may be formed of a synthetic resin foam. For example, foam made of a synthetic resin of polyurethane, styrene, etc., (for example, like sponge) is used as the synthetic resin foam. In such a configuration, if the press rotation body is heated by the endless belt placed on the heating roll and heated, the heat is not accumulated because of the heat insulation effect of the synthetic resin foam and thus hindering the cooing effect of the cooling structure by the press rotation body with heat accumulated is prevented.

The press pressure of the press rotation body 6 in the fuser may be set to 700 gf or less. In such a configuration, running of the endless belt and transporting of the record sheet P are not hindered if the press rotation body presses the endless belt, and are performed smoothly.

The press rotation body 6 in the fuser is supported on a support frame capable of swinging with a position upstream in the belt rotation direction from the position of the press rotation body 6 pressing the endless belt 3 as a supporting point. In such a configuration, the press rotation body can swing so as to move away from the endless belt to the side of opening the front of the record sheet in the transport direction thereof. Thus, if a paper jam occurs after the record sheet to support a toner image to be fixed is introduced into the fuser, the press rotation body is swung to the above-mentioned side by the jammed record sheet and thus the jammed record sheet does not stay in the fuser and is easily discharged.

The fuser of the invention can be used as a fuser of a multiple-color or a mono-color image formation apparatus using electrophotography and may also be used in conjunction with a multiple-color or a mono-color image formation apparatus installing another fuser. Particularly, in the latter mode, for example, the fuser of the image formation apparatus executes the first fixing and then the fuser of the invention joined to the image formation apparatus can execute the second fixing or only the fuser of the invention can execute fixing without executing fixing of the fuser of the image formation apparatus.

To the end, according to another aspect of the invention, there is provided a fixing belt shaped like an endless belt being overlaid on a record sheet to support toner for fixing the toner onto the record sheet as the fixing belt and the record sheet are heated and pressurized, characterized in that the minute hardness of a surface of the fixing belt coming in contact with the toner is 0.1 to 5.

The gloss degree of the belt surface coming in contact with the toner is 75 or more.

Further, the fixing belt is of a structure wherein an elastic layer and a surface layer are laminated in this order on a heat-resistant base material, and the elastic layer is a rubber layer having a rubber hardness of 15 degrees or less and a layer thickness of 70 $\mu$m or less and the surface layer is a fluorine-family resin layer having a gloss degree of 75 or more and a layer thickness of 20 $\mu$m or less.

The fixing belt can be applied to toner (image) fixing on a record material, such as plain paper or coated paper, on which a toner image can be formed by an image formation apparatus as the above-mentioned record sheet; particularly, the fixing belt is used most effectively when the record sheet is a record sheet comprising a thermoplastic transparent resin layer formed on a base material and the toner is fixed into the transparent resin layer.

Measurement load (load when an indentater reaches the push depth) was measured using a surface minute hardness meter (manufactured by Shimazu Seisakusho: DUH-201S) under the conditions listed below and the minute hardness was found according to the calculation expression described below based on the measurement load: The measurement conditions are as follows: Indentater shape: Triangular pyramid (115°), push speed: 0.142 mN/sec, push depth: 3 $\mu$m, test load: 7 mN, measurement environment: 23° C., 60% R.H. The calculation expression is as follows: Minute hardness=(constant×measurement load)÷(square of indentater push depth) (constant: 3.8584).

The gloss was measured using a gloss measuring apparatus (manufactured by Murakami Shikisai Kenkyuujyo: GLOSS METER MODEL GM-26D) under the conditions of a 75-degree incidence angle and a 75-degree light reception angle. Further, the rubber hardness was measured using an A-type hardness meter based on JIS K6250. In the description to follow, it is assumed that the minute hardness, the gloss, and the rubber hardness mentioned in the specification were found according to the measurement methods.

According to another aspect of the invention, there is provided a fuser comprising a fixing belt shaped like an endless belt being overlaid on a record sheet to support toner for fixing the toner onto the record sheet as the fixing belt and the record sheet are heated and pressurized, characterized in that as the fixing belt, any fixing belt of the invention as described above is used. Like the above-described fixing belt, the fuser can be applied to toner fixing on a record material on which a toner image can be formed by an image formation apparatus as the above-mentioned record sheet; particularly, the fuser is used most effectively when the record sheet is a record sheet comprising a thermoplastic transparent resin layer formed on a base material and the toner is fixed into the transparent resin layer.

Now, the respective embodiments of the invention will be described hereinafter.

(First Embodiment)

Figure 3:
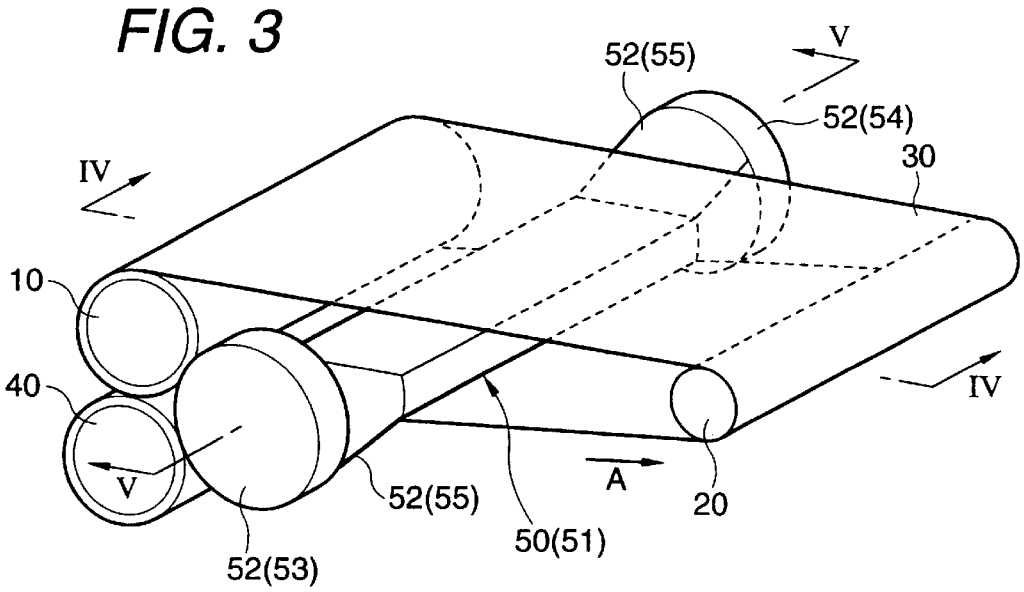
FIG. 3 is a schematic perspective view to show the main part of a fuser according to a first embodiment of the invention.
Figure 4:
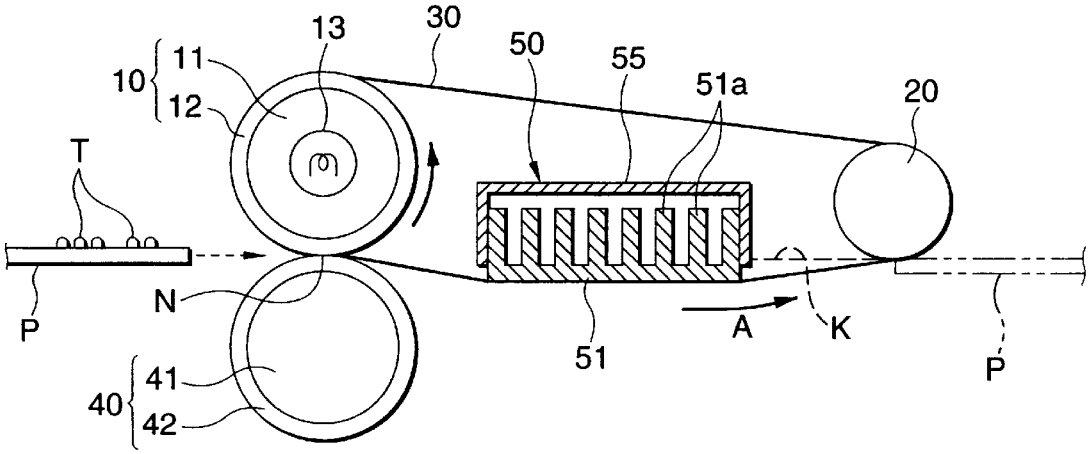
FIG. 4 is a schematic sectional view taken on line IV—IV of FIG. 3.
Figure 5:
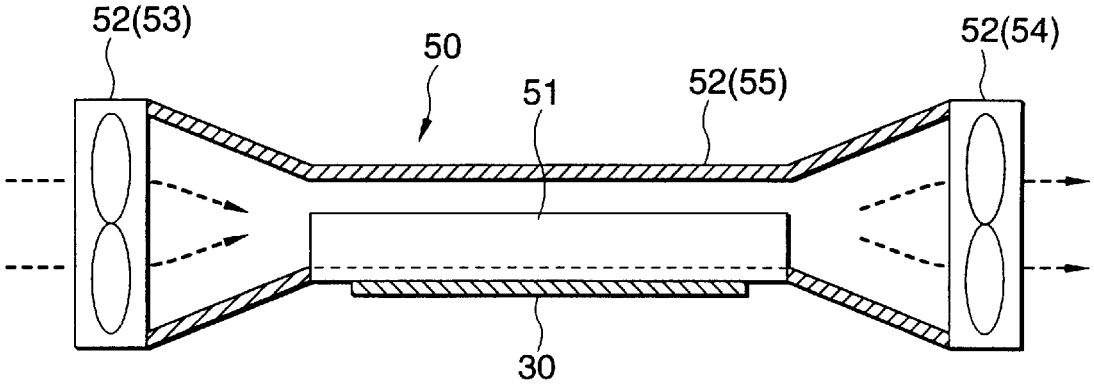
FIG. 5 is a schematic sectional view taken on line V—V of FIG. 3.
Figure 6:
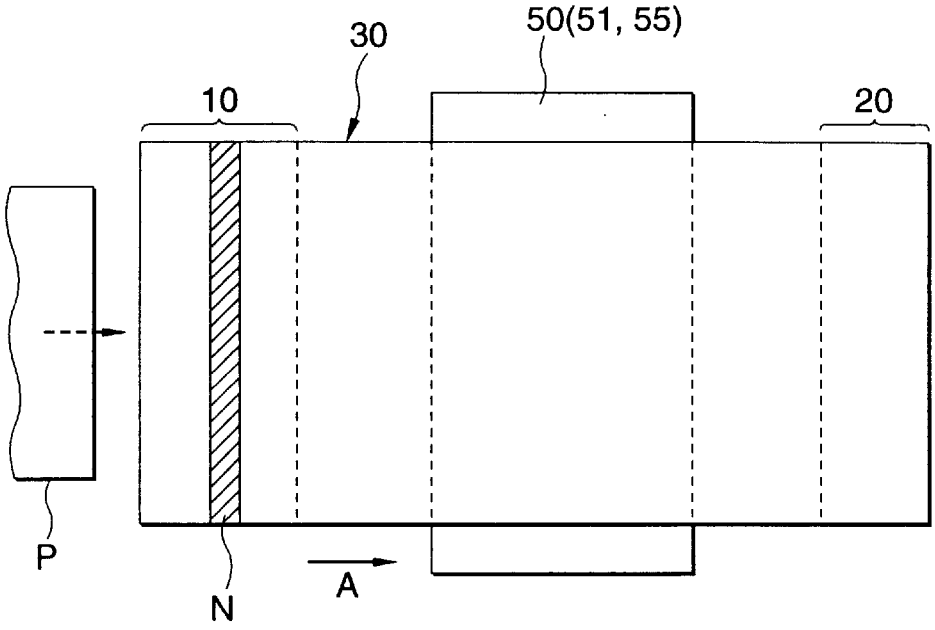
FIG. 6 is a schematic bottom view of the fuser in FIG. 3.

FIGS. 3 to 6 show the main part of a fuser according to a first embodiment of the invention. FIG. 3 is a perspective view of the fuser. FIG. 4 is a schematic sectional view taken on line IV—IV of FIG. 3. FIG. 5 is a schematic sectional view taken on line V—V of FIG. 3. FIG. 6 is a schematic bottom view of the fuser.

The fuser according to the first embodiment comprises a main section made up of a heating roll 10, a peeling roll 20, an endless belt 30, a pressurizing roll 40, and a cooling structure. In the figures, letter P denotes a record sheet and letter T denotes a toner image.

The heating roll 10 is made up of a roll main body formed with a coat layer 12 on a cylindrical roll core 11 made of aluminum, stainless steel, etc., and a heating halogen lamp 13 disposed in an internal space of the roll core 11. The coat layer 12 is formed of, for example, an elastic layer made of silicone rubber, etc., about 0.5 to 5 mm thick, a surface layer about several $\mu$m to several 10 $\mu$m thick, made of a fluorine-family resin, such as PFA, etc., formed on the surface of the elastic layer, and the like. The heating roll 10 is supported on a support frame (not shown) for rotation and is rotated in a predetermined direction (A) by known rotation drive means. The heating roll 10 is heated to a predetermined fixing heating temperature (for example, 120° C. to 180° C.) by the heating halogen lamp 13 and moreover the heating operation of the halogen lamp 13 undergoes feedback control based on sense information provided by a temperature sensor (not shown) for measuring the temperature of the heating roll surface so that the heating roll 10 is held at the predetermined fixing heating temperature.

The peeling roll 20 is a roll for placing the endless belt 30 thereon with the endless belt 30 bent in a predetermined curvature, thereby promoting peeling the record sheet P to fix a toner image, transported with the record sheet P abutted against the belt 30. For example, the peeling roll 20 is formed of a metal material of aluminum, SUS (stainless steel), etc. It is supported on the support frame (not shown) for rotation and is elastically urged in a direction of giving a tension to the endless belt by a known tension giving mechanism made of a spring, etc.

Figure 8:
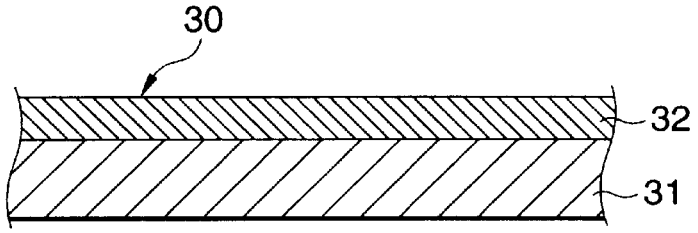
FIG. 8 is a schematic sectional view to show the configuration of the endless belt.

The endless belt 30 is made up of a belt base material 31 about 30 to 200 μm thick and an elastic release layer 32 about 10 to 200 μm thick formed on the outer peripheral surface of the base material 31, as shown in FIG. 8. The belt base material 31 is formed using a heat-resistant resin of polyimide, polyamide, etc., a metal material of nickel, aluminum, etc. The elastic release layer 32 is formed of silicone-family rubber, fluorine-family rubber, etc. It is desired that the outer peripheral surface of the endless belt 30 (specifically the surface of the elastic release layer 32) should be a smooth face (close to a mirror surface) as much as possible. The endless belt 30 is placed on the heating roll 10 and the peeling roll 20 and is rotated in the arrow A direction in the figure as the heating roll 10 is rotated.

The pressurizing roll 40 is disposed so as to press the endless belt 30 against the heating roll 10 and has the same layer structure as the roll main body of the heating roll 10, for example. A heating halogen lamp 13 may be disposed in the pressurizing roll 40 to add a heating function as required, as with the heating roll 10. The pressurizing roll 40 is supported on the support frame (not shown) for rotation and is also supported on a known pressurizing mechanism (not shown) to that it is urged in a press direction under a predetermined pressure (50 to 200 kgf). The pressurizing roll 40 presses the endless belt 30 against the heating roll 10, whereby a press portion (N) of a predetermined width is formed between the roll 40 and the endless belt 30 placed on the heating roll 10 (FIGS. 4 and 6).

The cooling structure 50 is made up of a radiation member 51 for cooling the inner peripheral surface portion of the endless belt 30 from the heating roll 10 to the peeling roll 20 while pressing the inner peripheral surface portion against the outer peripheral surface of the belt and an air cooling mechanism 52 for supplying air to the radiation member 51 for air cooling.

Figure 7:
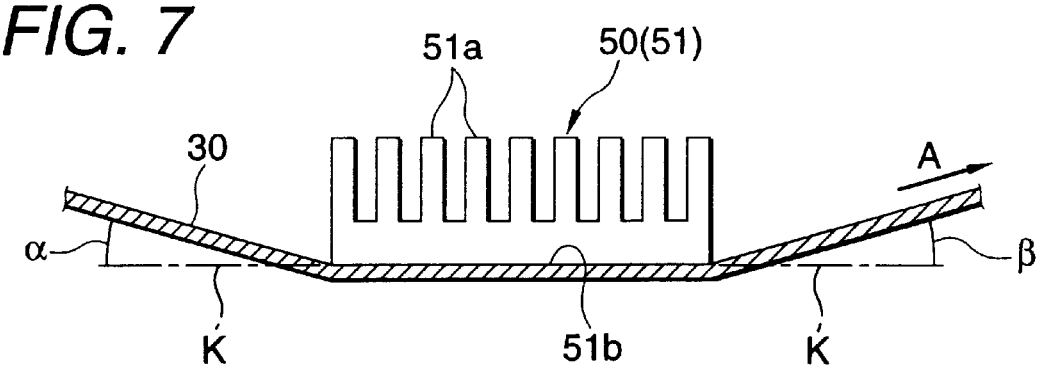
FIG. 7 is a schematic representation of the main part to show bend angles α and β of an endless belt with respect to a cooling structure and a press cooling face thereof in the first embodiment of the invention.

As shown in FIGS. 4 and 7, the radiation member 51 is implemented as a heat sink made of aluminum, etc., formed with a plurality of radiation fins 51*a* arranged side by side in parallel along the width direction of the endless belt 30 (direction orthogonal to the running direction A of the endless belt 30) The bottom face of the radiation member 51 is formed as a press cooling (heat absorbing) face 51*b* for pressing the inner peripheral surface of the endless belt 30. The press cooling face 51*b* is almost rectangular in cross section and has a full face as a smooth plane. On the other hand, the air cooling mechanism 52 is made up of an air fan 53, an air intake fan 54, and a ventilation duct 55 communicating from the air fan 53 through the radiation member 51 with the air intake fan 54, as shown in FIGS. 3 to 5. In the cooling structure 50, the radiation efficiency of the radiation member 51, the air cooling efficiency of the air cooling mechanism 52, and the like are appropriately set depending on the necessity for cooling the record sheet P to fix a toner image to what degree in what requirement (passage time), for example. The air cooling operation of the cooling structure 50 (the operation of the fans 53 and 54) is set so that it is performed while a sequence of fixing operation is executed after the heating roll 10 is heated to a predetermined fixing temperature.

As shown in FIG. 7, the cooling structure 50 in the fuser is set so that the bend angle of the part bent during the time between the endless belt 30 coming in contact with the press cooling face 51*b* of the cooling structure and exiting from the press cooling face 51*b* (namely, in the embodiment, the bend angle of the endless belt after coming in contact with the corner of the belt entry side of the press cooling face 51*b*), α, becomes about 5° C. The cooling structure 50 is set so that the bend angle of the exit part of the endless belt 30 from the press cooling face 51*b* of the cooling structure in a bend state (namely, in the embodiment, the bend angle of the endless belt after coming in contact with the corner of the belt exit side of the press cooling face 51*b*), β, becomes about 15° C. The radiation member 51 is so disposed as to be fixed and supported on the support frame (not shown) through the ventilation duct 55 so that the bend angles α and β satisfy the above-mentioned numeric conditions.

In the fuser, fixing is executed on the record sheet P to support a toner image T formed in a color image formation apparatus such as a color printer using electrophotography. Thus, disposed in the fuser is sheet transport means such as a belt transporter (not shown) for transporting the record sheet P to support a toner image T so as to introduce the record sheet P into the above-mentioned press region N between the endless belt 30 and the pressurizing roll 40. Also disposed in the fuser is discharge means such as a discharge roll pair (not shown) for discharging the record sheet P peeled off the endless belt 30 when the endless belt 30 arrives at the peeling roll 20 into a storage tray or any other post-treatment unit outside the fuser.

Figure 9:
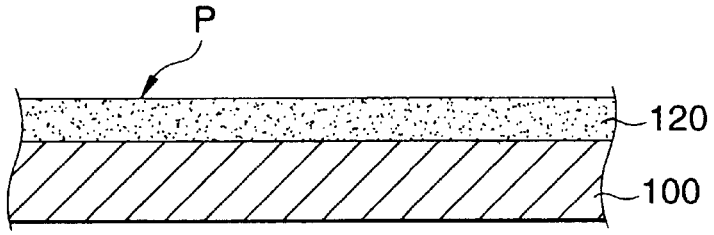
FIG. 9 is a schematic sectional view to show the configuration of a record sheet.

Further, the record sheet P to support a toner image to be fixed by the fuser is not limited if it is a record medium applicable to an image formation apparatus; a record medium comprising a transparent resin layer 120 consisting essentially of a thermoplastic resin laminated on a base material 100 as illustrated in FIG. 9 is used from the viewpoint of providing a photo-tone image rich in gloss by the fuser. Plain paper, coated paper, photographic paper, etc., for image formation can be named as the base material 100. Polyethylene resin, styrene-acrylic acid ester resin, etc., can be named as the thermoplastic resin forming the transparent resin layer 120. Preferably, the transparent resin layer 120 has a layer thickness to such an extent that it is fused by heating and pressurizing at the fixing time and a toner image T is buried into the transparent resin layer 120.

Figure 10A:
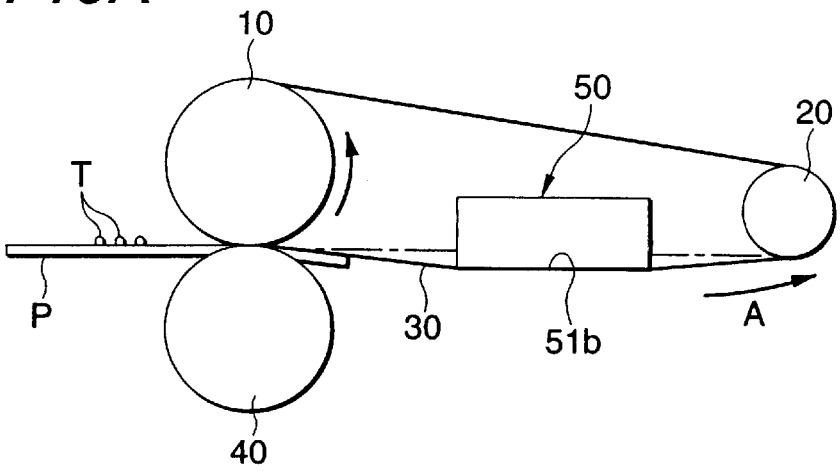
FIGS. 10A to 10C are schematic drawings to show main steps of the fixing operation.

Next, the operation of the fuser will be discussed with reference to FIGS. 10 and 11.

First, when the fixing operation time comes, the heating roll 110 starts to rotate so as to run the endless belt 30 in the arrow A direction and the heating halogen lamp 13 is energized and heated for heating the heating roll 10 to a predetermined fixing temperature and holding the heating roll 10 at the temperature. At this time, the pressurizing roll 40 start to be driven in response to rotation of the heating roll 10 through the endless belt 30. The cooling mechanism 52 of the cooling structure 50 (the fans 53 and 54) starts to operate before the heating roll 10 is heated to the predetermined fixing temperature and after the fixing operation is started.

Accordingly, the press region N between the fixing belt 30 and the pressurizing roll 40 is heated to the predetermined fixing temperature and the endless belt 30 is forcibly cooled by the radiation action when the portion pressed by the radiation member 51 of the cooling structure 50 is passed through.

Figure 11A:
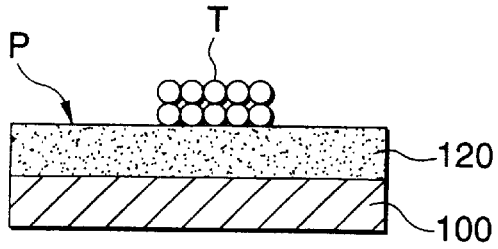
FIGS. 11A to 11D are schematic drawings to show a fixing process of a toner image onto a record sheet.
Figure 11B:
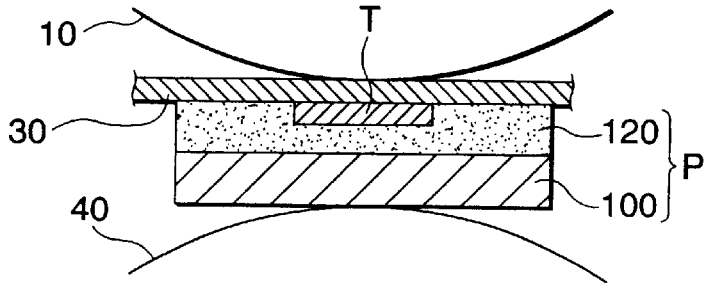

Subsequently, in the fuser in such a state, the record sheet P (FIG. 11A) onto which a toner image T formed in response to image information in an image formation apparatus is transferred is fed into the press region N between the fixing belt 30 and the pressurizing roll 40 by the paper transporter (not shown), as shown in FIG. 1A. Accordingly, the toner image T on the record sheet P is heated and pressurized in the press region N and is fused and buried into the transparent resin layer 120 of the record sheet P (FIG. 11B). The record sheet P is transported in the arrow A direction with rotation of the endless belt 30 with the record sheet P abutted against (brought into intimate contact with) the outer peripheral surface of the endless belt 30 still after the record sheet P passes through the press region N.

Figure 10B:
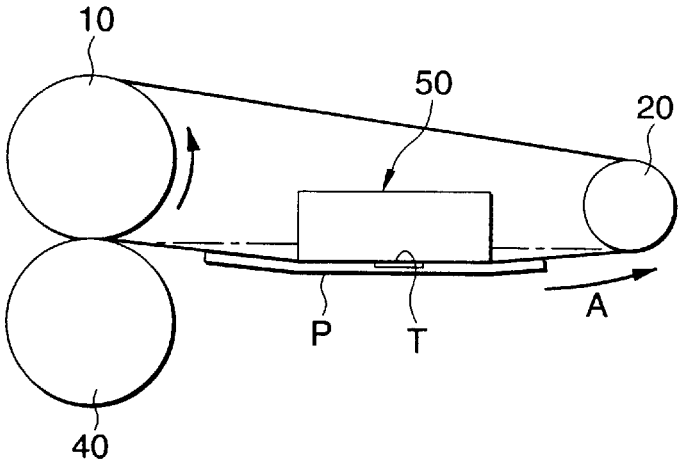
Figure 11C:
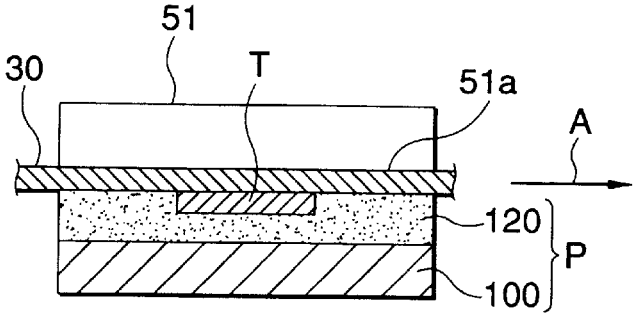

Next, the record sheet P abutted against the endless belt 30 is transported so as to pass through the belt portion (cooling area) pressed by the press cooling face 51*b* of the radiation member 51 of the cooling structure 50 with the record sheet P abutted against the endless belt 30, and is cooled by the radiation action of the radiation member 51 at the passage time, as shown in FIG. 10B. That is, while the record sheet P and the toner image T heated in the press region N pass through the cooling area, the heat of the record sheet P and the toner image T is transmitted through the endless belt 30 to the radiation member 51 for radiation (FIG. 11C). Moreover, the radiation is accomplished efficiently because the radiation member 51 is air-cooled by the air cooling mechanism 52. Accordingly, the toner image T and the transparent resin layer 120 of the record sheet P are cooled and almost hardened by the radiation action with the toner image T buried into the transparent resin layer 120 of the record sheet P.

Figure 10C:
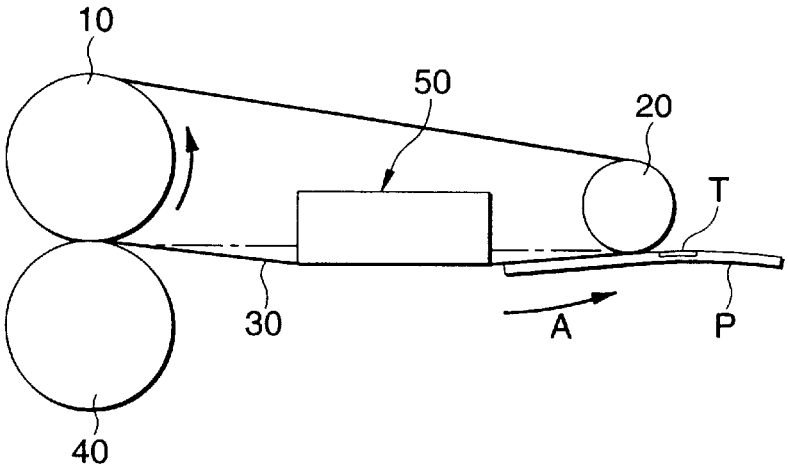

As shown in FIG. 10C, the record sheet P passing through the cooling area is transported to the peeling roll 20 with the record sheet P abutted against the endless belt 30 and is naturally peeled off the endless belt portion placed on the peeling roll 20 as the rotation state with the curvature of the endless belt 30 placed on the peeling roll 20 and firmness of the record sheet itself are contrary to each other. Then, the fixing is complete. The record sheet P peeled off the endless belt 30 is sent to the storage tray, etc., by the discharge means (not shown).

Figure 11D:
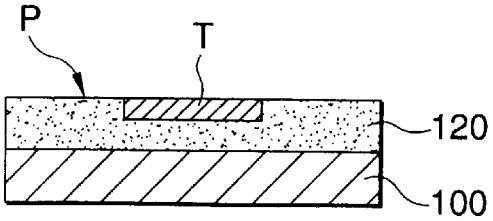

When the fixing is executed normally by the fuser, as a result of uniformly cooling particularly in the cooling area, the toner image T is fixed in such as state in which it is uniformly buried into the transparent resin layer 120 of the record sheet P, and after the fixing, the sheet surface (the surface of the transparent resin layer 120) becomes excellent in smoothness following the smooth surface of the endless belt 30, as shown in FIG. 11D. That is, after the fixing, the image on the record sheet P is provided as a high-quality image closely analogous to a photo image with less irregular reflection of light caused by surface asperities and rich in gloss.

Figure 12:
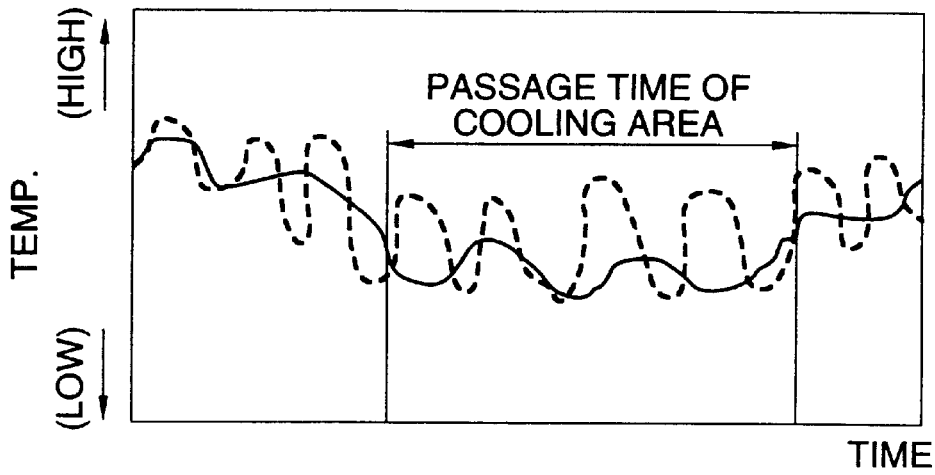
FIG. 12 is a graph to show the measuring results of the temperature state of a record sheet when the cooling structure presses the endless belt and comes in contact with the endless belt.

FIG. 12 shows the measuring results (solid line) of the temperature state of the record sheet P transported on the endless belt 30 before and after the cooling area where the endless belt 30 passes through the press cooling face 51*b* of the radiation member 51 of the cooling structure 50 and at the passage time. In the temperature measurement, the temperature is measured and shown when the endless belt 30 is run at constant speed with a thermocouple attached to the part of the record sheet P corresponding to the center of the endless belt 30 in the width direction thereof (namely, when the whole fuser is operated under the same condition as that at the actual fixing time). For comparison, the figure also shows the measuring results (dotted line) of the temperature state of the record sheet P when the press cooling face 51*b* of the radiation member 51 is simply brought into contact with the endless belt 30 (namely, when both the bend angles $\alpha$ and $\beta$ are 0°).

The main configuration of the fuser and the configuration of the record sheet used in the test are as follows: The heating roll 10 and the pressurizing roll 40 have roll base materials 11 and 41 each being a cylindrical roll made of aluminum 44 mm in outer diameter and 3 mm in thickness and coat layers 12 and 42 each having an elastic layer being silicone rubber (JIS-A hardness 40 degrees) 3 mm thick and a surface release layer being a PFA tube 3 $\mu$m thick. The endless belt 30 has a belt base material 31 being a belt having a perimeter of 168 mm made of a thermosetting polyimide film 80 $\mu$m thick and an elastic release layer 32 being a PFA coat layer 3 $\mu$m thick made of PFA. The width of the press region (N) between the endless belt 30 and the pressurizing roll 40 was 85 mm, the pressure was 5 kg/cm$^2$, and the fixing speed (the rotation drive speed of the heating roll) was 30 mm/s. On the other hand, the record sheet P having a base material 100 made of coated paper having a basis weight of 180 gsm and a transparent resin layer 120 made of a coat layer of a polyester resin was used. Styrene acrylic spherical toner containing wax (average particle diameter 5 $\mu$m) was used as toner forming a toner image.

The results shown in FIG. 12 reveal that if the press cooling face 51*b* of the radiation member 51 of the cooling structure 50 is pressed against the endless belt 30 by a predetermined amount (solid line), almost uniform cooling is accomplished and temperature unevenness is improved drastically as compared with the case where the press cooling face 51*b* is simply brought into contact with the endless belt 30. The reason is that a slight air layer intervening between the press cooling face 51*b* as the cooling area and the endless belt 30 is pushed out by pressing of the press cooling face 51*b* and the adhesion of the endless belt 30 to the press cooling face 51*b* is enhanced and thus the thermal conductivity from the record sheet P through the endless belt 30 to the radiation member 51 becomes stable. The reason why a little temperature unevenness exists even if the press cooling face 51*b* is pressed against the endless belt 30 is mainly that when the endless belt 30 enters the cooling area, a slight air layer as mentioned above sometimes exists in an arbitrary portion between the endless belt 30 and the press cooling face 51*b* and the cooling effect differs depending on whether or not the air layer exists, resulting in temperature unevenness (cooling unevenness), which is then reflected on the measurement value.

Figure 13:
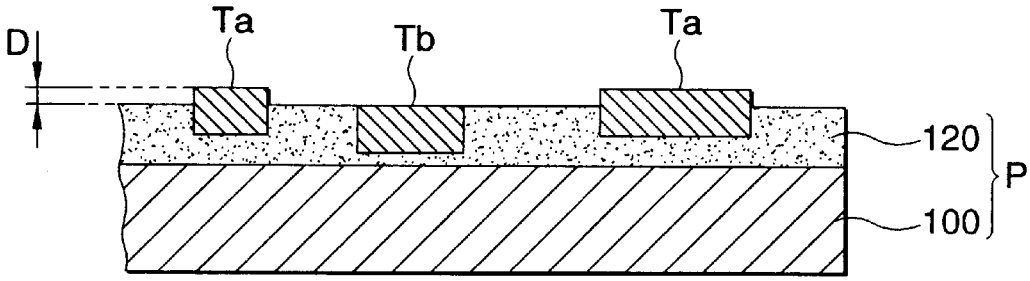
FIG. 13 is a schematic representation to show the state of a fixing failure when cooling unevenness (cooling failure) occurs.

If the record sheet P is not uniformly or stably cooled while it passes through the cooling area, as shown in FIG. 13, a toner image Ta once buried into the transparent resin layer 120 of the record sheet P by heating and pressurizing is not held in the bury state because of cooling temperature unevenness and floats up so as to produce a minute level difference D from the surface of the record sheet P and the possibility of fixing inferior in smoothness is raised. Tb in the figure indicates a toner image well cooled and fixed. The transparent resin layer 120 of the record sheet P and the toner T are not sufficiently cooled because of the above-mentioned cooling unevenness and their adhesion properties remain. Thus, when the record sheet P is peeled off the endless belt 30, the surface portion of the transparent resin layer 120, etc., not sufficiently cooled becomes minutely nappy and consequently gloss is impaired.

In the fuser, the press cooling face 51*b* of the radiation member 51 of the cooling structure 50 is pressed against the endless belt 30 to form the cooling area. However, if the amount of pressing the press cooling face 51*b* is increased, the record sheet P to support a toner image to be fixed easily peels off the endless belt 30 when it is being transported, and thus it is made impossible to accomplish uniform and stable cooling. Then, the inventor et al. examined the relationship between peeling of the record sheet P and the amount of pressing the press cooling face 51*b* of the radiation member 51 against the endless belt 30 using the fuser and the record sheet P configured as described above. The pressing amount was examined with the bend angle in the part of the endless belt 30 bent as the endless belt 30 is pressed by the press cooling face 51*b* as an index.

Figure 14A:
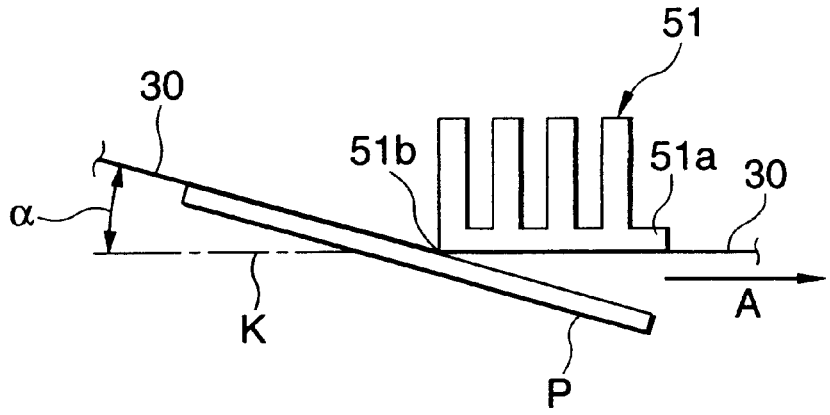
FIG. 14 is a schematic representation to show the relationship between the bend angles α and β of the endless belt with respect to the press cooling face and a peeling phenomenon of a record sheet.

That is, the following experiment was conducted: As illustrated in FIG. 14A, the belt bend angle $\alpha$ in the part of the endless belt 30 bent as the endless belt 30 comes in contact with the radiation member 51 (an end part 51*b* of the belt entry side) is changed gradually as the pressing amount of the radiation member 51 is changed, and what degree of the bend angle $\alpha$ the record sheet P peels off the endless belt 30 at is examined. Consequently, if the bend angle $\alpha$ exceeds 7°, the record sheet P cannot follow the running state of the bent endless belt 30 and peels just after at least the tip of the record sheet P transported in intimate contact with the endless belt 30 passes through the end part 51*b* of the belt entry side of the radiation member 51, as illustrated in FIG. 14A.

Figure 14B:
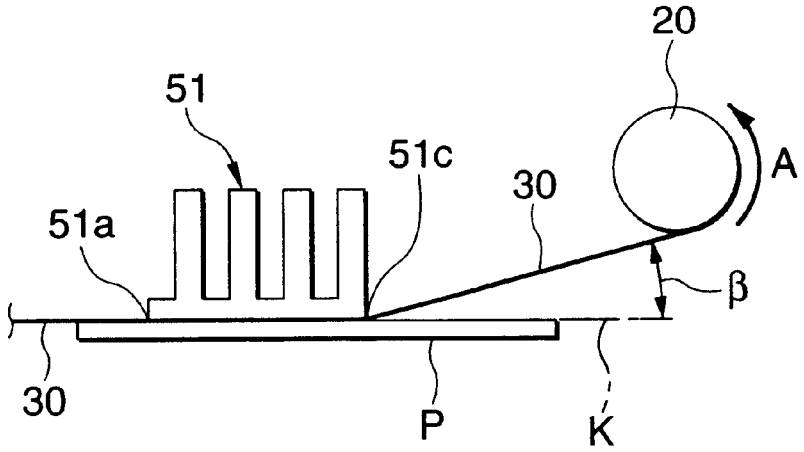

Likewise, the following experiment was conducted: As illustrated in FIG. 14B, the belt bend angle $\beta$ in the part of the endless belt 30 as the endless belt 30 is bent and exits from the radiation member 51 (an end part 51*c* of the belt exit side) is changed gradually as the pressing amount of the radiation member 51 is changed, and what degree of the bend angle $\beta$ the record sheet P peels off the endless belt 30 at is examined. Consequently, if the bend angle $\beta$ exceeds 22°, the record sheet P cannot follow the running state of the bent endless belt 30 and peels just after at least the tip of the record sheet P transported so as to pass through the cooling area in intimate contact with the endless belt 30 passes through the end part 51*c* of the belt exit side of the radiation member 51, as illustrated in FIG. 14B.

The experiment results revealed that in the fuser, at least the bend angle $\alpha$ needs to be placed in the range of $0<\alpha\leqq 7°$ to prevent the record sheet P from peeling when the endless belt 30 enters the cooling area where it is pressed by the press cooling face 51*b* of the radiation member 51. Further, the experiment results revealed that the bend angle $\beta$ needs to be placed in the range of $0<\beta\leqq 22°$ to prevent the record sheet P from peeling when the endless belt 30 has passed through the cooling area.

In this connection, in the fuser according to the embodiment, the bend angles $\alpha$ and $\beta$ are set to about 5° and about 15° respectively as mentioned above and thus the record sheet P transported in intimate contact with the endless belt 30 does not peel at the entry point or the exit point of the cooling area. Accordingly, a cooling failure or cooling unevenness accompanying peeling of the record sheet P while the record sheet P is transported on the endless belt 30 before and after the cooling area and passing through the cooling area is prevented from occurring. Consequently, a fixing failure caused by a cooling failure or cooling unevenness previously described with reference to FIG. 13 does not occur.

(Second Embodiment)

Figure 15:
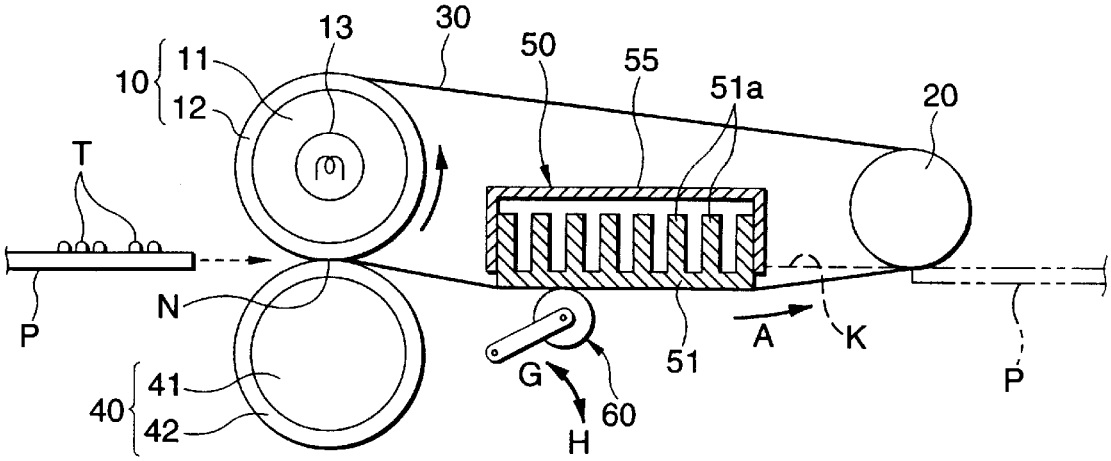
FIG. 15 is a schematic sectional view to show the main part of a fuser according to a second embodiment of the invention

FIG. 15 shows the main part of a fuser according to a second embodiment of the invention. The fuser according to the embodiment has the same configuration as the fuser according to the first embodiment except that it comprises a press roll 60 for pressing an endless belt 30 against a press cooling face 51*b* of a radiation member 51 in a cooling structure 50 from the outer peripheral surface of the endless belt 30.

Figure 16:
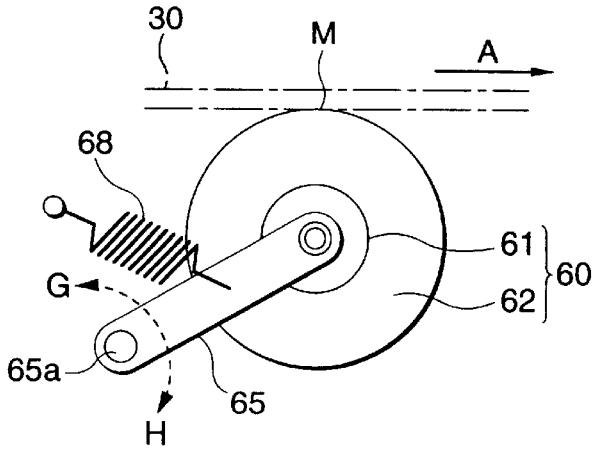
FIG. 16 is an enlarged schematic representation to show the configuration of a press roll.
Figure 17:
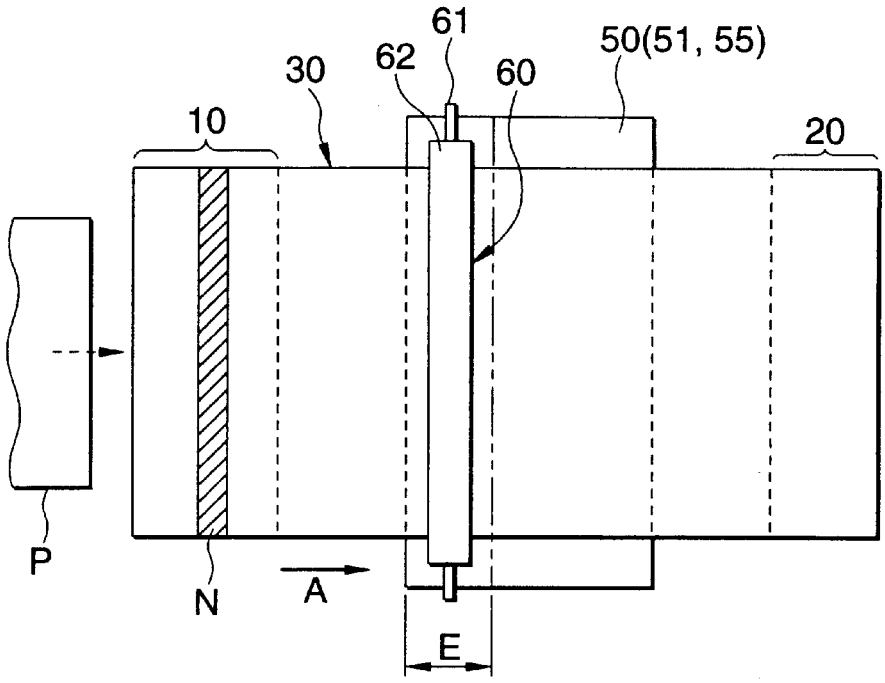
FIG. 17 is a schematic bottom view to show the press position of the press roll.

The press roll 60 has a roll diameter of about 5 to 30 mm and comprises a roll core 61 made of a metal material or a synthetic resin, the roll core 61 being formed with an elastic layer 62 made of a synthetic resin foam (for example, sponge of urethane) or the like, as shown in FIG. 16 and is formed so that the roll length (width) of the press roll 60 becomes larger than the width of the endless belt 30, as shown in FIG. 17. The press roll 60 is attached rotatably to a support arm 65 swinging in arrow G and H directions with a support shaft 65*a* as a supporting point, the support shaft 65*a* being positioned upstream in a belt rotation direction A from a position M of the roll 60 for pressing the endless belt 30, as shown in FIGS. 15 and 16. In FIG. 16, numeral 68 denotes a tension spring fixed at one end to a support frame (not shown) and is secured at an opposite end to a middle point of the support arm 65. The support arm 65 and by extension the press roll 60 is urged by the tension spring 68 in a direction G for pressing the endless belt 30 under a predetermined pressure. The press force of the press roll 60 is set to about 700 gf.

Figure 18:
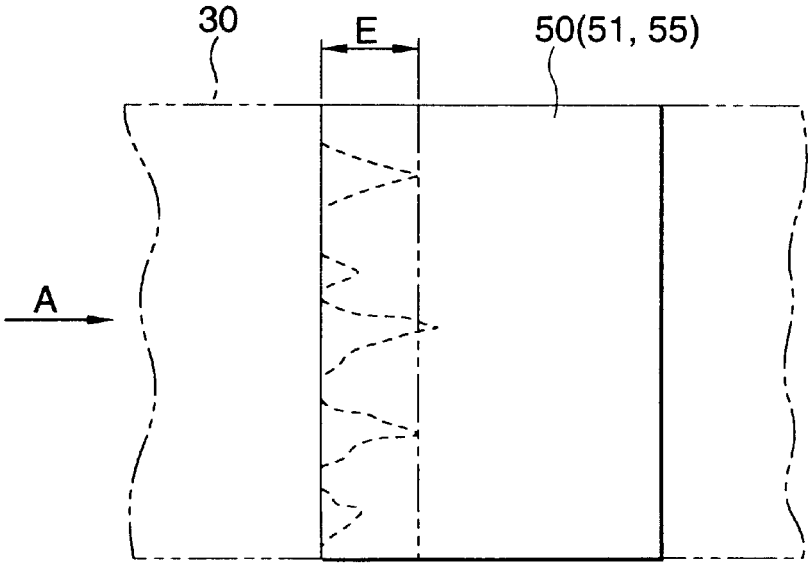
FIG. 18 is a schematic representation to show a non-contact portion occurring when an endless belt enters a press cooling face.

Further, the press roll 60 is disposed so that the position of pressing the endless belt 30 becomes at least within an area E to inner side 30 mm from the point of the press cooling face 51*b* of the radiation member 51 with which the endless belt 30 first comes in contact. The reason why the press roll 60 is so disposed is that in the area E, a non-contact portion (drawn by dotted lines) not coming in contact with the press cooling face 51*b* easily occurs as wrinkles of the belt itself, an air layer, or the like occurs just after the endless belt comes in contact with the press cooling face 51*b*, as shown in FIG. 18, and the non-contact portion becomes one cause of cooling unevenness and thus needs to be removed effectively and reliably. In the embodiment, the press roll 60 is set so as to press at a position of the inner side about 10 mm.

The fuser provided with the press roll 60 can accomplish basically the same fixing as the fuser according to the first embodiment and can provide the following advantages in the presence of the press roll 60:

As the press roll 60 presses the endless belt 30, the endless belt 30 comes in contact with the press cooling face 51*b* at a higher contact pressure, so that the cooling efficiency of the endless belt 30 and a record sheet P by the cooling structure 50 is more enhanced. Since the press roll 60 presses the endless belt 30 in the area E, a non-contact portion easily occurring when the endless belt 30 enters the press cooling face 51*b* is removed, and the endless belt 30 comes in contact with the press cooling face 51*b* more reliably and uniformly, so that cooling unevenness caused by the non-contact portion of the endless belt 30 is lessened. Consequently, the record sheet P to support a toner image to be fixed is cooled more uniformly and stably and thus the fuser can execute fixing to provide a high-quality image richer in gloss and smoothness.

Figure 19:
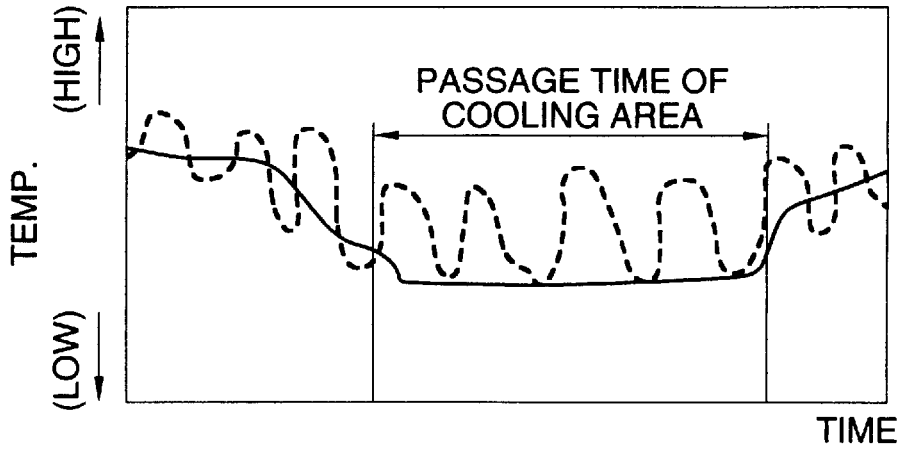
FIG. 19 is a graph to show the measuring results of the temperature state of a record sheet mainly in response to the presence or absence of the press roll.

FIG. 19 shows the measuring results (solid line) of the temperature state of the record sheet P transported on the endless belt 30 before and after the cooling area where the endless belt 30 passes through the press cooling face 51*b* of the radiation member 51 of the cooling structure 50 and at the passage time in the presence of the press roll 60. The temperature measurement is executed as the temperature state is measured as previously described with reference to FIG. 12 in the first embodiment. For comparison, the figure also shows the measuring results (dotted line) of the temperature state of the record sheet P when the press cooling face 51*b* of the radiation member 51 is simply brought into contact with the endless belt 30 without providing the press roll 60. Further, the test was conducted using a fuser and a record sheet P having similar configurations to those of the fuser and the record sheet P used in the test in the first embodiment except that the press roll 60 is provided. The results shown in FIG. 19 reveal that if the press roll 60 is provided for pressing the endless belt 30 against the press cooling face 51*b* of the radiation member 51 of the cooling structure 50 (solid line), uniform cooling is accomplished with no temperature unevenness.

In addition, the part of the press roll 60 coming in contact with the endless roll 30 is formed of the elastic layer 62 made of a synthetic resin foam, so that if the press roll 60 is heated by the endless belt 30, the heat is not accumulated and thus it is not feared that the press roll 60 with heat accumulated may heat and hinder the cooing effect of the cooling structure 50. Since the press force of the press roll 60 is set to the above-mentioned low value, running of the endless belt 60 and transporting of the record sheet P are not hindered if the press roll 60 presses the endless belt 30, and are performed smoothly. A test revealed that the press force of the press roll 60 capable of providing such an advantage may be set to 700 gf or less independently of the hardness of the elastic layer 62 of the press roll 60 or the like.

Figure 20A:
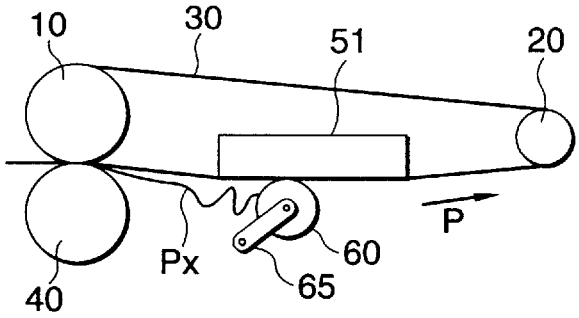
FIGS. 20A and 20B are schematic representations to show an advantage involved in the support configuration of the press roll.
Figure 20B:
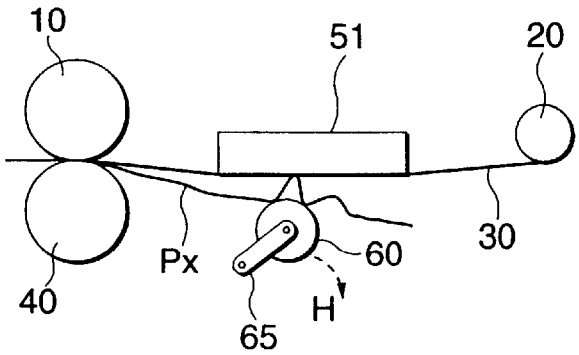

Further, the press roll 60 is supported on the support arm 65 swinging in the above-mentioned state, so that the press roll 60 can swing so as to move away from the endless belt 30 to the side (in the arrow H direction) of opening the front of the record sheet P in the transport direction A. Thus, if a paper jam occurs after the record sheet P to support a toner image to be fixed is introduced into the fuser, the press roll 60 is swung in the arrow H direction by the jammed record sheet Px and thus the jammed record sheet Px does not stay in the fuser and is easily discharged, as illustrated in FIG. 20.

(Modified Embodiments)

Figure 21:
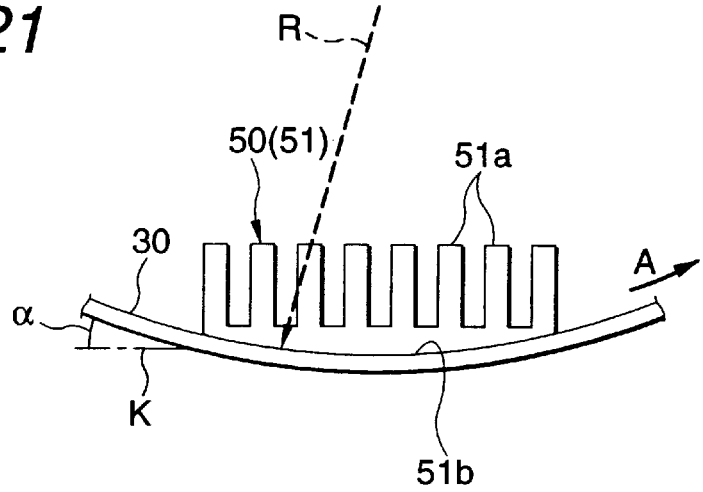
FIG. 21 is a schematic representation of the main part to show another configuration example of the press cooling face in a cooling structure (a curved surface having a curvature)

In the first and second embodiments, preferably the press cooling face 51*b* of the radiation member 51 in the cooling structure 50 is made a curved surface having a curvature (R) relative to the rotation direction A of the endless belt 30, as illustrated in FIG. 21. The curvature (R) can be set to 100 to 900 mm, for example, although it also varies depending on other conditions of the dimensions of the press cooling face 51*b*, etc. In the radiation member 51 having the press cooling face 51*b* of the curved surface, it is also necessary to dispose so that the bend angle $\alpha$ becomes within the specific range mentioned above, needless to say. In such a configuration, the adhesion of the endless belt 30 to the press cooling face 51*b* is enhanced as compared with the case where the press cooling face 51*b* is a flat surface in the first embodiment. Thus, the cooling efficiency of the record sheet by the cooling structure 50 through the endless belt 30 coming in contact with the press cooling face 51*b* of the curved surface is enhanced and occurrence of cooling unevenness is decreased still more.

Figure 22:
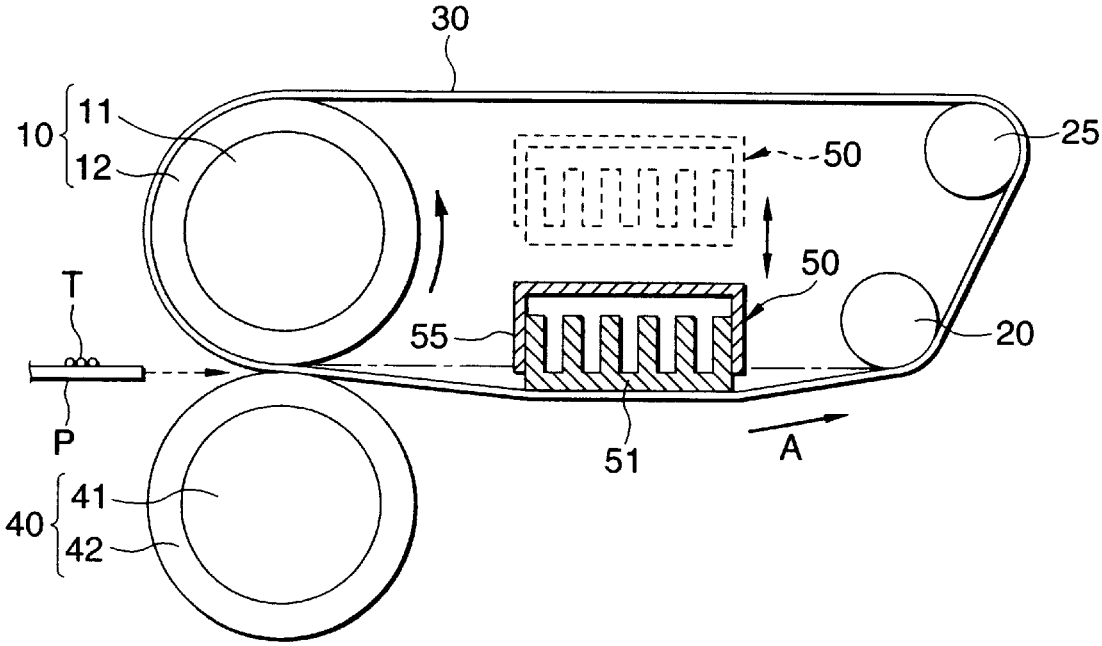
FIG. 22 is a schematic drawing of the main part to show another configuration example of the fuser according to the invention.

In the first and second embodiments, in addition to the heating roll 10 and the peeling roll 20, a third belt support roll 25 may be disposed for placing the endless belt 30 thereon, as illustrated in FIG. 22. In this case, the peeling roll 20 can be implemented as a driven roll fixedly disposed with no tension function and the third belt support roll 25 can be implemented as a tension roll. Further, a meandering prevention function of displacing (inclining) a bearing of an end part of the third belt support roll 25 in an up and down direction, etc., for correction in response to the meandering state of the endless belt 30 can also be added to the third belt support roll 25.

Further, in the first and second embodiments, the cooling structure 50 may be placed so that it can be brought into and out of contact with the endless belt 30, as illustrated in FIG. 22. Likewise, the press roll 60 in the second embodiment may also be placed so that it can be brought into and out of contact with the endless belt 30. In either case, the cooling structure 50 or the press roll 60 is supported displaceably by a known displacement mechanism, such as a cam mechanism and then the cooling structure 50 or the press roll 60 may be brought out of contact with the endless belt 30 at the non-operating time and may be brought into contact with and press the endless belt 30 when the record sheet P is transported to the front of the fuser at the fixing operation time.

The fuser according to the first or second embodiment may be provided with a peeling claw mechanism as an auxiliary member to reliably peel the record sheet P off the endless belt 30 placed on the peeling roll 20 or a cleaning unit for removing deposits on the outer peripheral surface of the endless belt 30 or the like as required. In addition, in the description of the fusers according to the first and second embodiments, the heating roll 10 is rotated for running the endless belt 30 in the predetermined direction A. However, the peeling roll 20 or the pressurizing roll 40 may be rotated for running the endless belt 30 in the predetermined direction A or the endless belt 30 may be run directly by dedicated drive means, as required.

Figure 23:
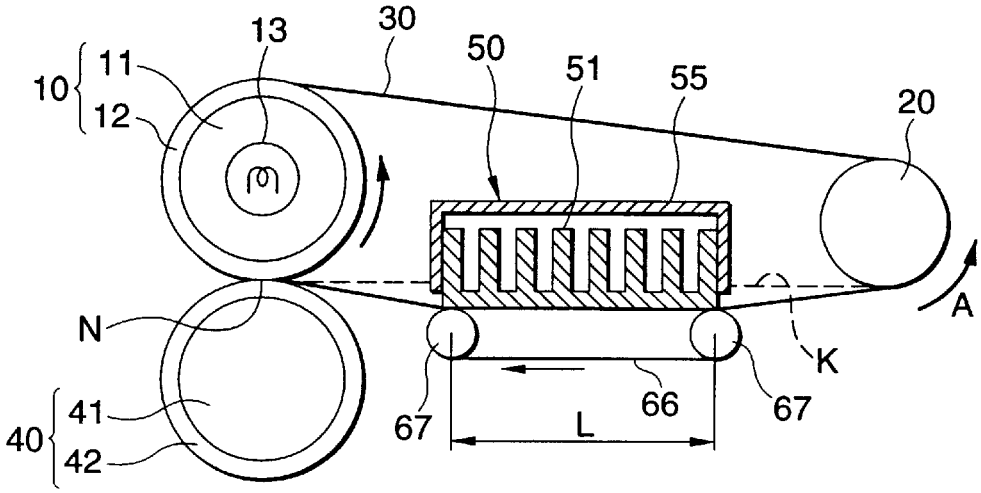
FIG. 23 is a schematic drawing of the main part to show a configuration example of providing a press belt.

Further, in the second embodiment, a press belt 66 placed on a plurality of support rolls 67 for rotation as illustrated in FIG. 23 maybe provided as a press rotation body for pressing the endless belt 30 in place of the press roll 60. In this case, each support roll 67 may be of the same roll structure as the press roll 60. Length L of the press belt 66 in the belt rotation direction A for pressing the endless belt 30 (namely, the length almost equivalent to the distance between the support rolls 67) is not limited to the case where it is made the same as the length of the press cooling face 51*b* in the belt rotation direction A and may be made shorter or longer than the length of the press cooling face 51*b*. The adhesion of the endless belt 30 to the press cooling face 51*b* by the press belt 66 can be enhanced regardless of the length relationship, and consequently the cooling efficiency of the cooling structure 50 can be enhanced.

(Third Embodiment)

Figure 24A:
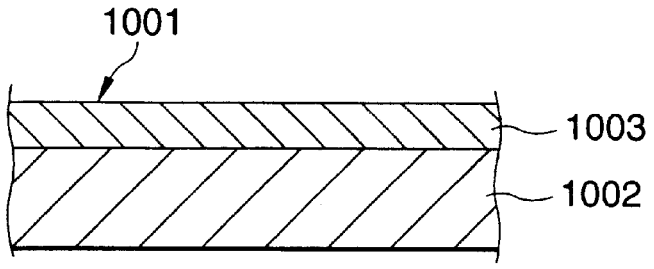
FIGS. 24A and 24B are sectional views of the main parts to show representative examples of fixing belts of the invention.
Figure 24B:
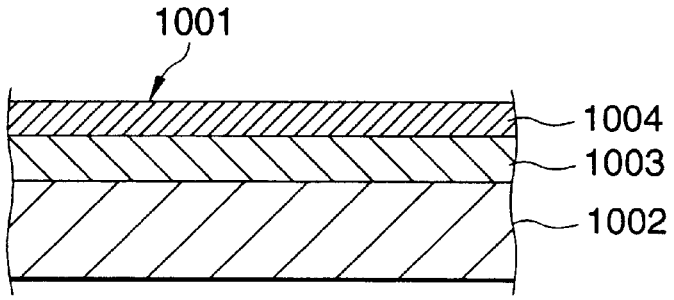

A fixing belt 1001 of the invention may be of a one-layer structure and preferably is of a multi-layer structure typified by a two-layer structure comprising at least an elastic layer 1003 laminated on a heat-resistant base material 1002 or a three-layer structure comprising at least an elastic layer 1003 and a surface layer 1004 laminated on a heat-resistant base material 1002, as illustrated in FIGS. 24A and 24B. Any functional layer other than the elastic layer 1003 or the surface layer 1004 may be laminated as required.

The fixing belt 1001 of the invention has a minute hardness of 0.1 to 5, preferably 0.5 to 3.5 on the belt surface coming in contact with toner regardless of the structure. The belt surface with such a minute hardness may show surface hardness as an intermediate area of rubber such as silicone rubber and a resin such as fluorine resin, and the surface characteristic makes it possible to reliably and sufficiently bury toner (described later) into a transparent resin layer of a record sheet. Such an advantage can be provided still more properly if the minute hardness is 0.5 to 3.5. If the minute hardness is less than 0.1, the push property of toner by the fixing belt becomes unstable and smoothing of an image surface by fixing becomes insufficient; in contrast, if the minute hardness exceeds 5, the push property of toner by the fixing belt may be too strong and trouble such that voids in an image portion easily occur is involved.

The fixing belt 1001 of the invention has a gloss degree of 75 or more, preferably 80 or more on the belt surface in addition the above-mentioned minute hardness on the belt surface coming in contact with toner. Since the fixing belt 1001 has such a gloss degree, it is made possible to execute fixing rich in a high gloss feeling in addition to providing smoothing of the image surface based on the minute hardness mentioned above. If the gloss degree as an index is less than 75, a disadvantage that a photo-level gloss feeling cannot be provided is involved.

The base material 1002 of the fixing belt 1001 is shaped like an endless belt about 20 to 150 μm thick, made of a heat-resistant resin of polyimide, polyamide, polyamide-imide, polybenzimidazole, etc., or a metal material of nickel, aluminum, etc.; preferably, the base material is made of polyimide, polybenzimidazole, etc., from the viewpoint of excellent heat resistance, etc.

The elastic layer 1003 is not limited if it is a layer having elasticity and a layer thickness of about 10 to 200 μm. However, from the viewpoint of meeting the above-mentioned minute hardness condition of the fixing belt surface, the following is preferred: A rubber layer made of silicone rubber having a rubber hardness of 70 degrees or more (layer thickness: 10 to 100 μm), an elastic layer made of a complex of polydimethyl siloxane (average molecular weight 6500, molar ratio 0.15 to 0.25) and organic metal alcoxide (metal: Si, Ti, Ta, Zr, etc.,) (layer thickness: 10 to 100 μm), or the like can be named as the elastic layer 1003 when the surface layer 1004 is not provided. A rubber layer made of silicone rubber having a rubber hardness of 15 degrees or less (layer thickness: 70 μm or less, preferably 20 to 50 μm) or the like can be named as the elastic layer 1003 when the surface layer 1004 is provided. The elastic layer 1003 has a storage elastic modulus of 3 to 200 MPa at 130° C., preferably 3 to 50 MPa at 130° C. The storage elastic modulus was measured using a dynamic viscoelasticity automatic measuring apparatus (manufactured by JSR: MODEL DDV-01FP) under the following measurement conditions: Excitation mode is single waveform (sine wave), amplitude is 80 μm, frequency is 10 Hz, and temperature rise rate is 2.0° C./min. The elastic layer 1003 can be formed using a coating method of immersion application, spraying, etc., or a method of putting a film form (elastic film), etc.

The surface layer 1004 is not limited if it is a layer having a layer thickness of about 3 to 20 μm to give any desired substance property of a release property, etc., for example. However, from the viewpoint of meeting the above-mentioned minute hardness condition of the fixing belt surface, the following is preferred: A resin layer made of fluorine-family resin such as a 4-ethylene fluoride polymer or a copolymer of 4-vinyl ether fluoride (PFA) or the like can be named. The surface layer 1004 can be formed using a coating method of immersion application, spraying, etc., or a method of putting a film form (film), etc.

To provide the surface layer 1004, preferably it is a surface layer formed on the elastic layer 1003 (rubber layer made of silicone rubber having a rubber hardness of 15 degrees or less and having a layer thickness of 70 μm or less) and having a gloss degree of 75 or more, preferably 80 or more and a layer thickness of 20 μm or less, preferably 7 to 12 μm. In this case, if the rubber hardness of the elastic layer 1003 exceeds 15 degrees, any desired minute hardness of the belt surface cannot be provided or any other problem occurs, and if the layer thickness exceeds 70 μm, thermal conductivity is worsened or any other problem occurs. On the other hand, if the gloss degree of the surface layer 1003 becomes less than 75, a photo-level gloss feeling cannot be provided as with the above-mentioned case and if the layer thickness exceeds 20 μm, any desired minute hardness of the belt surface cannot be provided. Particularly, to provide the surface layer 1004 with a gloss degree of 75 or more, specular gloss treatment needs to be conducted on the surface of the layer made of fluorine-family resin. This specular gloss treatment is conducted using a method of grinding the surface with a grinding tape in a wet or dry manner; it is important to select the grinding conditions appropriately in such a manner that a grinding tape having a higher yarn number than 5000 is selected.

Figure 25:
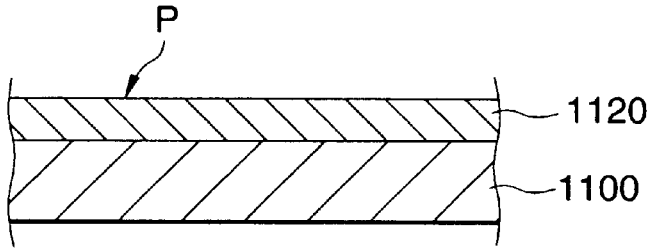
FIG. 25 is a sectional view of the main part to show a record sheet applied in the invention.

The fixing belt 1001 of the invention can be used in combination with various types of record materials that can be used with general image formation apparatus, such as plain paper and coated paper; particularly, it is effective to use the fixing belt 1001 in combination with a record sheet P comprising a thermoplastic transparent resin layer 1120 on a base material 1100, as shown in FIG. 25. Plain paper, coated paper, photographic paper, etc., for image formation can be named as the base material 1100 of the record sheet P. The transparent resin layer 1120 functions as a Layer that can be fused at the fixing time for receiving toner (image reception layer) and is formed of a thermoplastic resin such as polyethylene resin, polyester resin, or styrene-acrylic acid ester resin and is about 5 to 30 μm thick. The transparent resin layer 1120 is formed using a coating method of blade coating, etc.

Figure 26A:
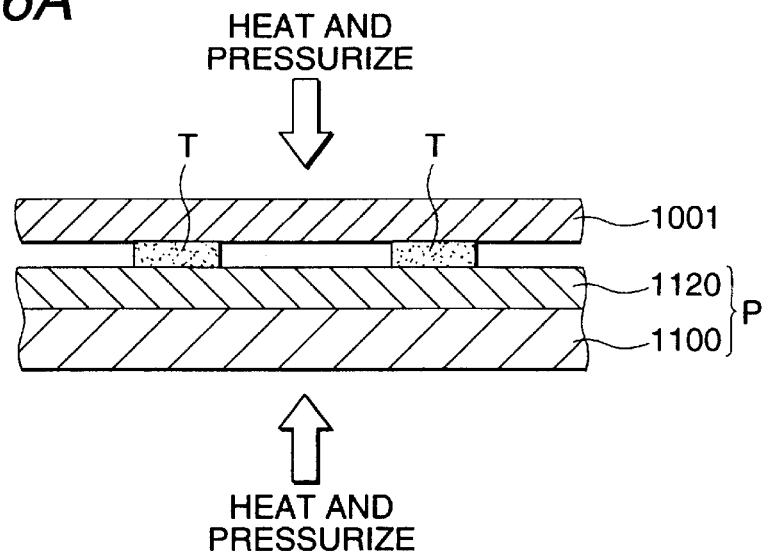
FIGS. 26A and 26B are schematic drawings of the main parts to show a fixing state by the fixing belt of the invention and the state of a record sheet provided after the fixing.
Figure 26B:
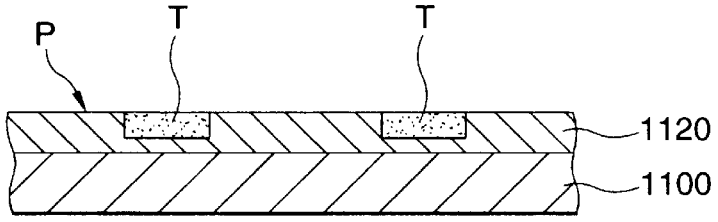

The fixing belt 1001 is used in such a manner that the fixing belt 1001 and the record sheet P to support a toner (image) T to be fixed are overlaid on each other so that the belt surface side (formation face side of the elastic layer 1003 and the surface layer 1004) comes in contact with the toner T and then the fixing belt 1001 and the record sheet P overlaid on each other are heated and pressurized by known heating means and pressurizing means as illustrated in FIG. 26A, whereby the toner T is fixed onto the surface of the record sheet P (into the transparent resin layer 1120 if the record sheet P in FIG. 25 is applied) as illustrated in FIG. 26B. The heating temperature at this time is set to a temperature at least to such an extent that the tone T (and the transparent resin layer 1120) is fused.

Figure 27:
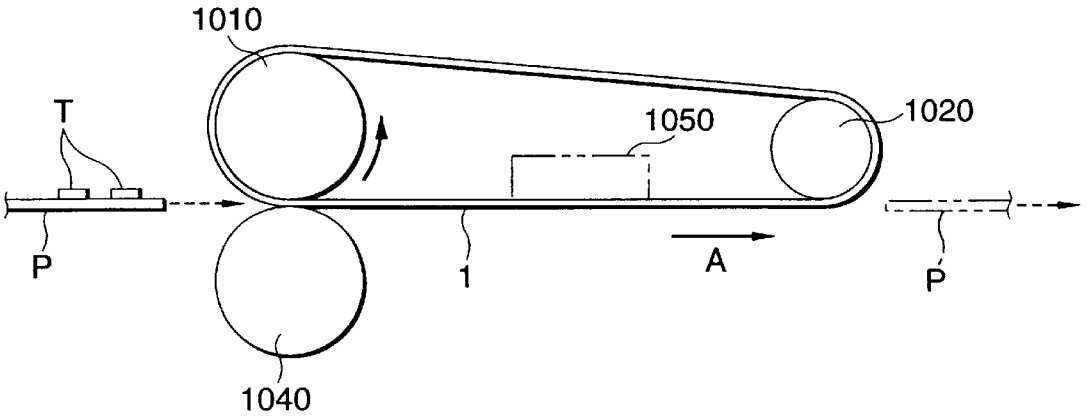
FIG. 27 is a schematic drawing to show the main part of a fuser of the invention.

FIG. 27 is a schematic drawing to show the main part of a fuser using the fixing belt 1001 of the invention.

The fuser basically comprises a heating roll 1010 and a peeling roll 1020 on which the fixing belt 1001 is placed for running the fixing belt 1001 and a pressurizing roll 1040 for pressing the fixing belt 1001 against the heating roll 1010. It is of the type wherein the record sheet P to support toner T is introduced into a nip region N formed between the fixing belt 1001 and the pressurizing roll 1040 and the toner T is fixed into the transparent resin layer 1120 of the record sheet P.

The heating roll 1010 is made up of a roll main body formed with a coat layer on a cylindrical roll core made of aluminum, stainless steel, etc., and a heating halogen lamp disposed in an internal space of the roll core. The coat layer is formed of, for example, an elastic layer made of silicone rubber, etc., about 0.5 to 5 mm thick, a surface layer about 10 μm to 200 μm thick, made of a fluorine-family resin, such as PFA, etc., formed on the surface of the elastic layer, and the like. The heating roll 1010 is supported on a support frame (not shown) for rotation and is rotated in a predetermined direction (A) by known rotation drive means. The heating roll 1010 is heated to a predetermined fixing heating temperature (for example, 120° C. to 180° C.) by the heating halogen lamp and moreover the heating operation of the halogen lamp undergoes feedback control based on sense information provided by a temperature sensor (not shown) for measuring the temperature of the heating roll surface so that the heating roll 1010 is held at the predetermined fixing heating temperature.

The peeling roll 1020 is a roll for placing the fixing belt 1001 thereon with the fixing belt 1001 bent in a predetermined curvature, thereby promoting peeling the record sheet P to fix a toner image, transported with the record sheet P abutted against the belt 30. For example, the peeling roll 1020 is formed of a metal material, etc. It is supported on the support frame (not shown) for rotation and is elastically urged in a direction of giving a tension to the fixing belt 1001 by a known tension giving mechanism made of a spring, etc. In the fuser, a peeling fixed member such as a pad-like member, fixedly disposed may be used in place of the peeling roll 1020 as required if the fixing belt 1001 can be placed and supported on the member for running the fixing belt 1001 smoothly.

The pressurizing roll 1040 is disposed so as to press the fixing belt 1001 against the heating roll 1010 and has the same layer structure as the roll main body of the heating roll 1010, for example. A heating halogen lamp may be disposed in the pressurizing roll 1040 to add a heating function as required, as with the heating roll 1010. The pressurizing roll 1040 is supported on the support frame (not shown) for rotation and is also supported on a known pressurizing mechanism (not shown) to that it is urged in a press direction under a predetermined pressure.

In the fuser, fixing is executed on the record sheet P to support a toner image T formed in a color image formation apparatus such as a color printer using electrophotography. Thus, disposed in the fuser is sheet transport means such as a belt transporter (not shown) for transporting the record sheet P to support a toner image T so as to introduce the record sheet P into the above-mentioned nip region N between the fixing belt 1001 and the pressurizing roll 1040. Also disposed in the fuser is discharge means such as a discharge roll pair (not shown) for discharging the record sheet P peeled off the fixing belt 1001 when the fixing belt 1001 arrives at the peeling roll 1020 into a storage tray or any other post-treatment unit outside the fuser. To sense whether or not the fixing operation terminates, a sheet sensor for sensing the presence or absence of passage of the record sheet P after fixing and peeling is disposed in the proximity of the record sheet peeling and discharging side of the peeling roll 1020.

Next, the fixing operation of the fuser is as follows:

First, when a fixing operation start signal is input, the heating roll 1010 starts to rotate so as to run the fixing belt 1001 in the arrow A direction and the heating halogen lamp is energized and heated for heating the heating roll 1010 to a predetermined fixing temperature and holding the heating roll 1010 at the temperature. At this time, the pressurizing roll 1040 start to be driven in response to rotation of the heating roll 1010 through the fixing belt 1001.

Figure 28A:
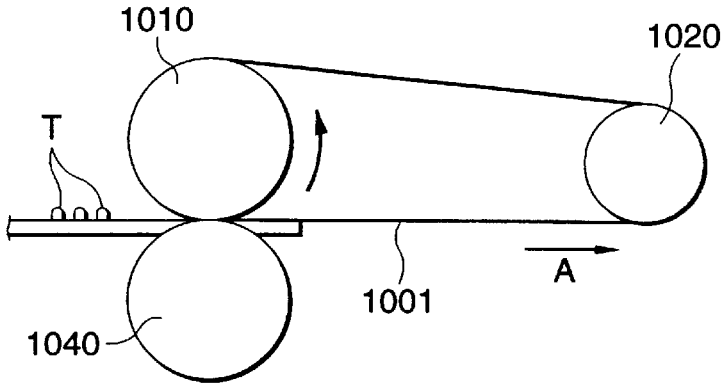
FIGS. 28A, 28B, and 28C are schematic drawings to show the main steps of the fixing operation.

In the fuser in such a state, the record sheet P onto which a toner image T formed in response to image information in an image formation apparatus is transferred is fed into the nip region N between the fixing belt 1001 and the pressurizing roll 1040 by the paper transporter (not shown), as shown in FIG. 28A. Accordingly, the toner image T on the record sheet P and the transparent resin layer 1120 are heated and pressurized in the nip region N and are fused and the toner T is buried into the transparent resin layer 1120 of the record sheet P.

Figure 28B:
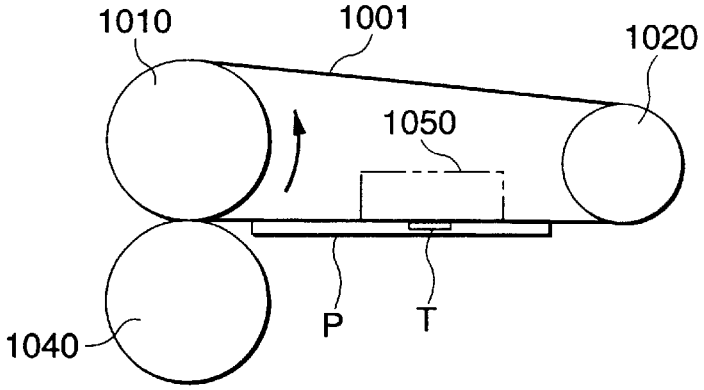

Subsequently, the record sheet P passing through the nip region N is transported in the arrow A direction with rotation of the fixing belt 1001 with the record sheet P abutted against (brought into intimate contact with) the outer peripheral surface of the fixing belt 1001 still after the record sheet P passes through the nip region N, as shown in FIG. 28B. The record sheet P is naturally cooled while it passes through a cooling area until the record sheet P is transported to the vicinity of the peeling roll 1020 in the state. Accordingly, the toner T is cooled and almost hardened on the surface layer portion of the record sheet P; with the record sheet P of the structure illustrated in FIG. 25, the toner T is cooled and almost hardened with the toner image T buried into the transparent resin layer 1120 of the record sheet P.

Figure 28C:
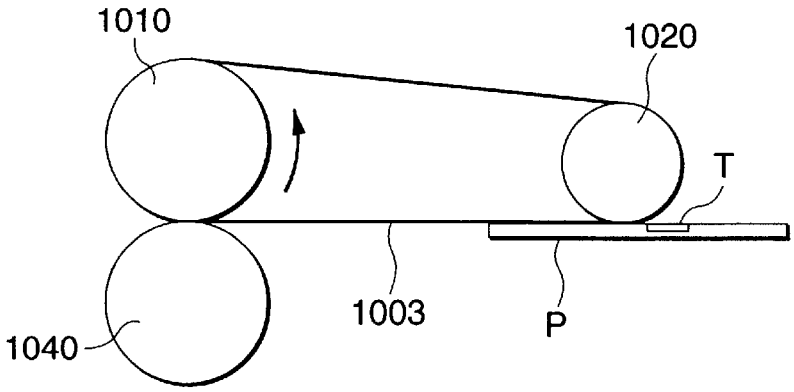
Figure 29A:
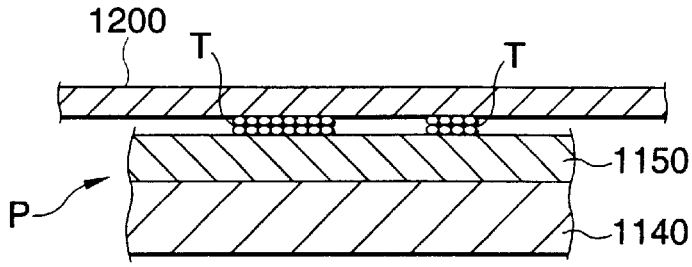
FIGS. 29A and 29B are conceptual drawings of the main part to show a fixing mode adopted in the invention.
Figure 29B:
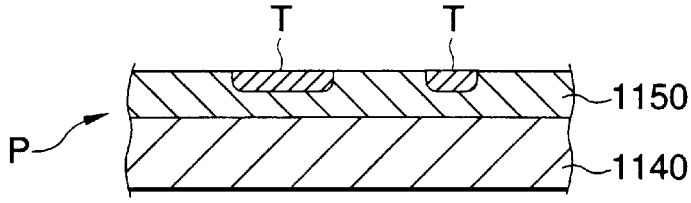

As shown in FIG. 28C, when the record sheet P passing through the cooling area is transported to the peeling roll 1020 with the record sheet P abutted against the fixing belt 1001, it is naturally peeled off the fixing belt portion placed on the peeling roll 1020. Then, the fixing is complete. The record sheet P peeled off the fixing belt 1001 is sent to the storage tray, etc., by the discharge means (not shown).

In the fuser, if a sufficient spacing between the heating roll 1010 and the peeling roll 1020 cannot be provided and it is difficult to naturally cool the record sheet P on the fixing belt 1001, cooling means 1050 may be provided on the inside of the fixing belt 1001 between the heating roll 1010 and the peeling roll 1020, as indicated by the phantom line in FIG. 27. For example, means for pressing a radiation member such as a heat sink against the inner peripheral surface of the fixing belt 1001 and moreover air-cooling the radiation member can be used as the cooling means 1050. If the cooling means 1050 is provided, the record sheet P to support the toner image to be fixed, passing through the nip region N and transported with the record sheet P in intimate contact with the fixing belt 1001 is forcibly cooled by the cooling means 1050 as shown in FIG. 28B, so that any desired cooling can be accomplished.

Further, the fuser may be provided with a peeling claw mechanism as an auxiliary member to reliably peel the record sheet P off the fixing belt 1001 placed on the peeling roll 1020 or a cleaning unit for removing deposits on the outer peripheral surface of the fixing belt 1001 or the like as required. Any belt support roll other than the heating roll 1010 or the peeling roll 1020 to place the fixing belt 1001 thereon may be added. Further, running of the fixing belt 1001 is not limited to that as the heating roll 1010 is rotated, and maybe performed as any other roll is rotated.

The fuser of the invention can be used as a fuser of a multiple-color or a single-color image formation apparatus using electrophotography and may also be used in conjunction with a multiple-color or a single-color image formation apparatus installing another fuser. Particularly, in the latter mode, for example, the fuser of the image formation apparatus executes the first fixing and then the fuser of the invention joined to the image formation apparatus can execute the second fixing or only the fuser of the invention can execute fixing without executing fixing of the fuser of the image formation apparatus.

The invention will be further discussed with examples and control examples.

EXAMPLE 1

A solution provided by dissolving polyamide acid (manufactured by Ube Kosan: Trade name u varnish S) in a solvent of dimethylacetamide/naphtha (9:1) was centrifugally formed and then was subjected to heat treatment to provide a polyimide base material shaped like an endless belt 80 μm in thickness, 168 mm in diameter, and 340 mm in perimeter (belt base material) To prevent the belt from being charged, a proper amount of carbon black is dispersed in the base material. Next, an organic-inorganic hybrid sol liquid comprising organic metal alcoxide made of Ti as an inorganic component and polydimethyl siloxane having an average molecular weight of 6500 was prepared so that the molar ratio (organic component/(organic component+inorganic component)) becomes 0.23, and was applied onto the belt base material using a flow coating method. Then, it was calcined under the conditions of 0.5 hours at 200° C. and 0.2 hours at 300° C. Accordingly, a fixing belt of a two-layer structure comprising an elastic layer made of an organic-inorganic hybrid film 10 μm thick formed on the belt base material made of polyimide resin was provided.

EXAMPLE 2

A fixing belt of a two-layer structure was provided under the same conditions as in Example 1 except that the molar ratio in the organic-inorganic hybrid sol liquid was changed to 0.15.

EXAMPLE 3

A coat of silicone rubber having a rubber hardness of 80 degrees (manufactured by Toray Dow Coaning Silicone: SE4450) was applied onto the same polyimide base material as in Example 1 with an applicator. Then, it was dried for two hours at 120° C. and further was subjected to heat treatment for four hours at 200° C. Accordingly, a fixing belt of a two-layer structure comprising a rubber elastic layer made of silicone rubber 80 μm thick formed on the belt base material made of polyimide resin was provided.

EXAMPLE 4

HTV (heat curing type) silicone rubber having a rubber hardness of 15 degrees (manufactured by Toray Dow Coaning Silicone: JCR6115CLEAR) was applied onto the same base material made of polyimide resin film as in Example 1 and then was subjected to heat treatment for 0.5 hours at 120° C., whereby a rubber elastic layer 50 μm thick was formed on the belt base material. Next, immersion coating of a copolymer of 4-ethylene fluoride and 4-vinyl ether fluoride (manufactured by Daikin Kougyou: AD-2CR) as fluorine resin was applied onto the surface of the rubber elastic layer and then the coat was subjected to heat treatment for 0.5 hours at 330° C. in a nitrogen atmosphere, thereby forming a surface layer 10 μm thick. Last, specular gloss treatment (for example, grinding with imperial wrapping film SiC (2 μm, yarn number 6000) manufactured by Sumitomo 3M) was conducted on the surface of the belt (surface layer) so that the gloss became 75 or more. Accordingly, a fixing belt of a three-layer structure having a gloss degree of 85 on the belt surface was provided.

EXAMPLE 5

A fixing belt of a two-layer structure was provided under the same conditions as in Example 4 except that forming the rubber elastic layer was excluded.

COMPARATIVE EXAMPLE 1

A coat of HTV silicone rubber having a rubber hardness of 50 degrees (manufactured by Toray Dow Coaning Silicone: SE4705U) was applied onto the same polyimide base material as in Example 1 with an applicator and then was subjected to heat treatment for four hours at 200° C. Accordingly, a fixing belt of a two-layer structure formed with a rubber elastic layer 50 μm thick was provided.

COMPARATIVE EXAMPLE 2

A fixing belt of a one-layer structure 80 μm thick was provided only using the polyimide base material solely in Example 1.

COMPARATIVE EXAMPLE 3

A fixing belt of a two-layer structure was provided under the same conditions as in Example 4 except that forming the rubber elastic layer was excluded and except that conducting the specular gloss treatment on the surface was excluded.

The minute hardness, the storage elastic modulus at 130° C., and the gloss (75°) of the belt surface of the fixing belt in each of the examples and the control examples thus provided were measured. Table 1 lists the measurement results.

(Evaluation Test)

Next, each of the fixing belts provided in Examples 1 to 5 and Control examples 1 to 3 was installed in the fuser shown in FIG. 4, then the fuser was built in a color image formation apparatus (manufactured by Fuji Xerox: Modified machine of Docu Color 1250) as a fuser thereof and image formation was executed for evaluation test. In the test, a record sheet comprising a thermoplastic transparent resin layer made of polyester resin about 15 μm thick formed on a coated base material having a basis weight of 160 gsm and a record sheet comprising a thermoplastic transparent resin layer made of polyester resin about 15 μm thick formed on a coated base material having a basis weight of 210 gsm were used. Toner having an average particle diameter of 6 μm, made of styrene acrylic resin, etc., to which a wax component is added was used. A color image, etc., was formed on each record sheet in the test toner and the color image was fixed by the fuser of the invention. The gloss (75°) of the image portion on the record sheet after the fixing, thus provided was measured and the occurrence state of edge voids of the image portion and the state of a level difference of a patch image portion were visually evaluated for the purpose of checking the bury property of the toner. Table 1 also lists the results.

Figure 30A:
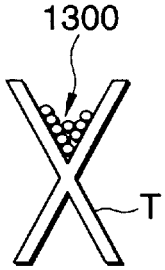
FIGS. 30A and 30B are schematic representations to show an edge void of an image portion occurring when a fixing belt in a related art is used, etc.

As the test evaluation for edge voids, X-shaped images as shown in FIG. 30A were formed in three color (yellow, magenta, and cyan) toners and deposited on each other and were multiple-transferred onto a record sheet, then fixed. The void length state at the cross part of the X-shaped image provided on the record sheet was observed by the naked eyes. The result was evaluated based on the following criterion:

○: Good (no void): Δ Some voids, X: Occurrence on full face.

Figure 30B:
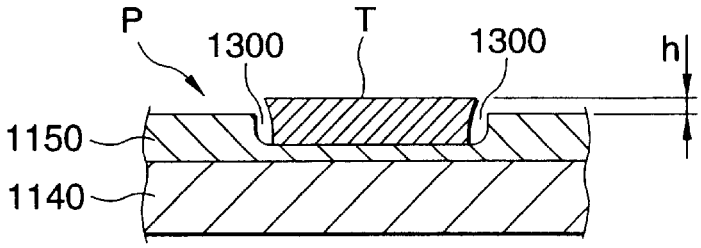
Figure 31A:
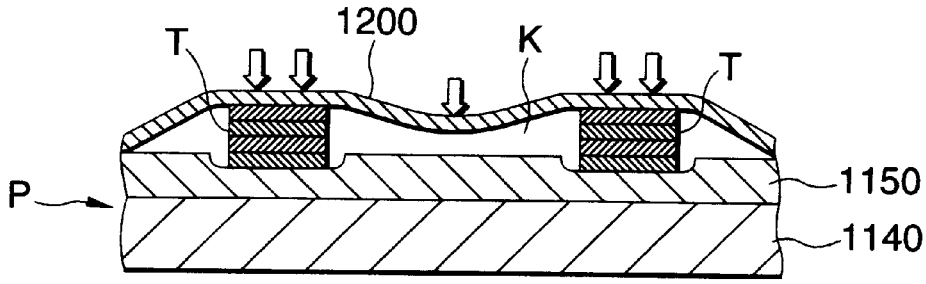
FIGS. 31A and 31B are schematic representations to show fixing failures occurring when various fixing belts in related arts are used, etc.
Figure 31B:
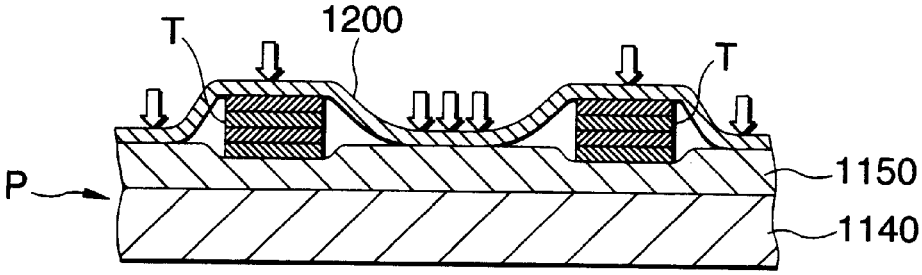

As the test evaluation for the level difference of the patch image portion, patch images each of a square with one side being 15 mm were formed in three color (yellow, magenta, and cyan) toners and deposited on each other and were multiple-transferred onto a record sheet, then fixed. The state of level difference h between the patch image provided on the record sheet and the record sheet surface (see FIG. 30B) was observed by the naked eyes. The result was evaluated based on the following criterion:

○: Good (no level difference), Δ: Slight level difference observed, X: Clear level difference observed.

TABLE 1

| | Fixing belt | | | | | | |
|---|---|---|---|---|---|---|---|
| | Storage | | | Evaluation | | | |
| | Minute hard-ness | elastic mod-ulus (MPa) | Gloss belt surface | Gloss image portion | Edge void *1 | Patch Level Diff. *1 | Remarks |
| EX. 1 | 1.1 | 40 | 92–95 | 98–100 | ○/○ | ○/○ | |
| EX. 2 | 3.4 | 45 | 89–92 | 97–100 | ○/○ | ○/○ | |
| EX. 3 | 0.5 | 3.5 | 91–94 | 95–100 | ○/○ | ○/○ | |
| EX. 4 | 0.3 | — | 78–85 | 90–95 | ○/○ | ○/Δ | |
| EX. 5 | 4.2 | 85 | 78–85 | 90–95 | ○/Δ | ○/○ | |
| COMP 1 | 0.03 | 2.2 | 90–95 | 95–100 | ○/○ | X/X | Wax offset occur. |
| COMP 2 | 25.4 | 400 | 98–100 | 98–100 | Δ/X | ○/○ | Toner offset occur. |
| COMP 3 | 4.2 | 85 | 30–50 | 40–60 | ○/Δ | ○/○ | Low image gloss |

*1: (Left: For 160-gsm sheet)/(right: For 210-gsm sheet)

From the results listed in Table 1, if the minute hardness of the belt surface is less than 0.1 (control example 1), the patch image level difference can be visually observed and if the minute hardness exceeds 5 (control example 2), voids are conspicuous in the image edge parts. If a pictorial image like a portrait is fixed under the condition, a so-called relief-toned image with asperities observed is provided in the former case and an image with conspicuous roughness and unevenness of the light and dark boundary portion is provided in the latter case. In Control example 1, it was observed that the wax component added to the toner was deposited (offset) on the surface of the fixing belt and in Control example 2, it was observed that some toner was deposited on the surface of the fixing belt. In Control example 3, it was recognized that the gloss of the provided image was extremely low as compared with the gloss of any other image.

As the test was further repeated, when the minute hardness was in the range of 0.1 to 5, it was checked that a problem as described above was not involved if a pictorial image like a portrait was fixed. Further, when the minute hardness was in the range of 0.5 to 3.5, an image free of a problem as described above was provided even if a cardboard (having a high basis weight) was used. Since the gloss of the fixing belt surface was high, a photo-level highly glossy image was also provided on the image sample surface.

As described above, according to the fuser of the invention, the endless belt from the heating roll to the peeling roll and the record sheet to support a toner image to be fixed, transported with the record sheet abutted against the endless belt are cooled uniformly and stably by the cooling means for cooling while pressing the endless belt from the inner peripheral surface thereof, and good fixing with no cooling unevenness can be accomplished.

As described above, according to the fixing belt and the fuser of the invention, good image fixing excellent in smoothness and rich in gloss feeling can be executed without occurrence of voids in image edge parts or a smoothing failure of the image surface. Such an advantage can be provided most remarkably particularly in the fixing system wherein the record sheet is a record sheet comprising a thermoplastic transparent resin layer formed on a base material and the toner is fixed into the transparent resin layer.

What is claimed is:

1. A fuser comprising:

a heating roll;

a peeling roll being spaced from said heating roll;

an endless belt being at least placed on said peeling roll and said heating roll and run;

a pressurizing roll for pressing said endless belt against said heating roll; and a cooling structure having a press cooling face being disposed on an inner peripheral surface of said endless belt for cooling the inner peripheral surface portion of said endless belt from said heating roll to said peeling roll while pressing the inner peripheral surface portion in a direction of an outer peripheral surface of said endless belt;

wherein said endless belt is run in a passage direction in the order of said heating roll, said cooling structure, and said peeling roll; and wherein a record sheet to support a toner image is introduced into a press area between said endless belt placed on the heating roll and said pressurizing roll, the portion of the record sheet with which the press cooling face of the cooling structure comes in contact in a state in which the record sheet is abutted against said endless belt is passed through, and the record sheet is transported to the portion of said endless belt placed on said peeling roll and is peeled off, whereby the toner image is fixed onto the record sheet.

2. The fuser as claimed in claim 1, wherein the press cooling face of said cooling structure is a curved surface having a curvature relative to the belt rotation direction.

* * * * *